United States Patent [19]

Burandt

[11] Patent Number: 4,723,515

[45] Date of Patent: Feb. 9, 1988

[54] MECHANISM UTILIZING A SINGLE ROCKER ARM FOR CONTROLLING AN INTERNAL COMBUSTION ENGINE VALVE

[75] Inventor: Corliss O. Burandt, Plymouth, Minn.

[73] Assignee: Investment Rarities Incorporated, Minneapolis, Minn.

[21] Appl. No.: 880,550

[22] Filed: Jun. 30, 1986

Related U.S. Application Data

[63] Continuation of Ser. No. 622,039, Jun. 22, 1984, abandoned, which is a continuation-in-part of Ser. No. 491,819, May 5, 1983, Pat. No. 4,495,902.

[51] Int. Cl.[4] ..... F01L 1/34

[52] U.S. Cl. ..... 123/90.16; 123/90.17; 123/90.25; 123/90.34; 123/90.45

[58] Field of Search ..... 123/90.16, 90.25, 90.17, 123/90.34, 90.44, 90.45, 90.26

[56] References Cited

U.S. PATENT DOCUMENTS

| | | | |
|---|---|---|---|
| 2,410,660 | 11/1946 | Howard | 123/90.16 |
| 2,791,206 | 5/1957 | Engemann | 123/90.45 |
| 2,880,712 | 4/1959 | Roan | 123/90.16 |
| 4,261,307 | 4/1981 | Oldberg | 123/90.16 X |
| 4,469,056 | 9/1984 | Tourtelot, Jr. et al. | 123/90.16 |

FOREIGN PATENT DOCUMENTS

| | | | |
|---|---|---|---|
| 151108 | 11/1980 | Japan | 123/90.16 |

*Primary Examiner*—Charles J. Myhre
*Assistant Examiner*—Peggy A. Neils
*Attorney, Agent, or Firm*—Peterson, Wicks, Nemer & Kamrath

[57] ABSTRACT

The operating mechanism for opening and closing the valve of an internal combustion engine includes a single generally L-shaped rocker arm having a vertical leg formed with a cam follower surface that is engaged by a cam unit mounted on the engine's camshaft. The rocker arm also includes a horizontal leg having an adjustable eccentric device carried at its free end that is engageable with the upper end of the valve member for determining the amount of valve lash. The rocker arm is mounted on a shiftable axis provided by a lever arm, one end of the lever arm being pivotal about a fixed axis. The vertical leg of the rocker arm is raised and lowered so as to present various follower portions on the vertical leg to the cam unit as it rotates. The cam unit includes a pair of flanking cams, both of which may have identical profiles or profiles that differ from each other in order to achieve desired valve opening and closing patterns. At least one flanking cam has ramp portions which are angularly oriented with other ramp portions associated with the lobe on the central cam assigned the primary responsibility of opening and closing the valve.

30 Claims, 31 Drawing Figures

HYDRAULIC AMPLIFIER
74
78
134
102
100
138
80c
132
118
36
152
70d
148
66
80b
82
70
80
76
70a
38
150
82a
34
56
80a
68
140
144
58
84
72
70c
10
154
20
32
26
156
24
22
28
160
158
18
158
30
162
14

74
78
134
132
138
86a
152
36
148
72c
82
80
140
68
66
70c
72a
72b
150
70b
34
56
70a
144
142
58
70d
72d
72
10
20
32
26
18
24
28

MECHANISM UTILIZING A SINGLE ROCKER ARM FOR CONTROLLING AN INTERNAL COMBUSTION ENGINE VALVE

CROSS-REFERENCE TO RELATED APPLICATIONS

This is a continuation of Ser. No. 622,039, filed June 22, 1984, now abandoned which is a continuation in part of Ser. No. 491,819 filed May 5, 1983, now U.S. Pat. No. 4,495,902, for "MECHANISM FOR VARIABLY CONTROLLING AN INTERNAL COMBUSTION ENGINE VALVE."

In addition, my copending applications titled "VARIABLE VALVE OPERATING MECHANISM FOR INTERNAL COMBUSTION ENGINE", Ser. No. 310,655 filed on Oct. 13, 1981, now U.S. Pat. No. 4,414,931, and "APPARATUS UTILIZING A PLURAL-PROFILED CAM UNIT FOR ACTUATING THE VALVE OF AN INTERNAL COMBUSTION ENGINE", Ser. No. 378,842 filed on May 17, 1982 (now abandoned in view of continuation application, Ser. No. 622,038 filed June 22, 1984 pending) contain subject matter generally related to this application.

BACKGROUND OF THE INVENTION

1. Field of the Invention

This invention relates generally to internal combustion engines, and pertains more particularly to a mechanism utilizing a single rocker arm for variably controlling the operation of one or more of an internal combustion engine's valves.

2. Description of the Prior Art

Various mechanisms have been devised for controlling the opening and closing of the inlet and exhaust valves associated with internal combustion engines. An example of one such prior art mechanism is the mechanism disclosed in U.S. Pat. No. 2,934,052, granted on Apr. 26, 1960 to Irvin R. Longenecker for "VALVE OPERATING MECHANISM." While other prior art mechanisms possess various shortcomings, such as being capable of controlling only valve lift or valve duration, but not both, the mechanism described in the referred to Longenecker patent results in more friction than is desirable and concomitantly produces excessive lateral thrust on the valve stem that is also objectionable. In addition, other mechanisms have been quite massive, involving a considerable amount of inertia, and requiring more space than is sometimes available, particularly when installed on the engines of compact and subcompact vehicles. Still others are quite complicated and costly to manufacture, thereby discouraging their adoption.

SUMMARY OF THE INVENTION

One important object of my invention is to provide a valve operating mechanism that will control either the intake or exhaust valves of an internal combustion engine, controlling both the lift and duration, but doing so in a simple and straightforward manner. In this regard, an aim of the invention is to accomplish the control with a minimum number of parts, thereby reducing the cost, complexity and inertia of my valve control mechanism when compared with others known to me.

Another important object of the invention is to provide a mechanism capable of intake valve throttling.

A further and important object is to reduce mechanical stresses in the valve actuating linkage, thereby enabling higher engine speeds to be employed. More specifically, it is within the purview of my invention to employ an eccentric having ramp portions associated therewith that decrease the severity of valve shock by cushioning both the opening and closing of the valve. In this regard, it is planned that a number of ramps be provided, and that their profiles vary in order to achieve appropriate opening and closing patterns of the valve.

In this regard, in one aspect of the invention, an aspect which is closely allied with the preceding object through the agency of the eccentric ramp portions, the cam and rocker arm wear is shifted from one surface area to other surface areas during the opening and closing segments of the valve operation cycle for different load conditions. However, it is also envisioned that there be a further reduction of frictional forces by reducing the wiping action between the rocker arm and the valve stem, this being achieved through the expedient of providing an optimum rocking motion for various valve openings.

A further object is to reduce appreciably the friction that has heretofore been experienced with various valve control mechanisms, thereby minimizing both wear and maintenance, as well as reducing the power required to operate the valve in each instance where my mechanism is employed.

Another object of the invention is to provide a control mechanism for valves that will be small in size, thus enhancing its use with engines for powering compact cars where the space beneath the hood is at a premium.

Yet another object of the invention is to provide a valve control mechanism in which the valve lift and valve lash can be adjusted in a predetermined relationship with respect to each other. Stated somewhat differently, the single rocker arm utilized in the practicing of my invention can be designed to change the valve lift for various load conditions to which the engine is subjected either with or without changing the valve lash, as circumstances dictate.

Still another object of the invention is to provide a single rocker arm that has a cam follower profile such as to impart a desmodromic action to the rocker arm so that a valve spring having a lesser spring strength can be employed in contrast to the stronger springs that have been needed to effect a proper valve closing when conventional valve operating mechanisms have been used. It is also optionally planned that a semi-desmodromic action of the valve itself be achieved, and that the degree of such action be adjustable. Stated more specifically, it is within the purview of the invention to provide a mechanism capable of producing race car performance at high speeds, the semi-desmodromic action making it possible to achieve high valve lifts, together with long durations under this type of operating condition.

The invention has for still a further object the provision of a separate and distinct valve operating mechanism for each valve of an internal combustion engine, each mechanism being capable of being independently adjusted relative to the others, thereby enabling the amount of valve movement for each valve to be individually obtained or to be obtained for groups of valves such as one pattern of valve movement for all of the intake valves and a different pattern for all of the exhaust valves.

For a further object, the invention provides a valve operating mechanism utilizing a single rocker arm in which the valve acted on by the rocker arm can be designed to open either faster or slower as valve lift is increased to accommodate various load conditions. In this regard, it is an aim of the invention to select in advance a particular leverage ratio by contouring the cam follower profile portion of the rocker arm such that the leverage ratio is either increased or decreased, a decrease in the ratio further reducing impact forces that the lobe portion of the cam produces as it engages the rocker arm during each revolution of the camshaft. In other words, it is within the purview of the present invention to decrease the rate of valve acceleration as the valve lift increases. Thus, one embodiment of my invention enables an appreciable reduction in the impact or shock forces that are exerted on the valve during the time that it is being initially actuated from a closed position toward an open position and vice versa.

Briefly, the valve operating mechanism exemplifying my invention comprises a single generally L-shaped rocker arm having a vertical leg formed with a cam follower surface that is engaged by a cam unit mounted on the engine's camshaft, there being preferably one of my mechanisms for each valve. The cam follower surface includes either two or three separate sections, each section having a different profile. In this regard, one section is preferably linear and the other one or two (as the case may be) sections nonlinear (actually curved). The linear section may slope in a positive direction when the leverage ratio is to be decreased in accordance with an increase in valve lift, the latter having the effect of moderating impact forces applied to the valve. The rocker arm also includes a horizontal leg having an adjustable eccentric carried at its free end that is engageable with the upper end of the valve member to be actuated.

A lever arm is pivotally mounted at one end to a shaft providing a fixed axis, and an intermediate portion of the lever arm is pivotally connected to the rocker arm by means of a pin spaced from the fixed axis, the pin extending transversely through the vertical leg of the rocker arm. To reduce the amount of wiping action, and hence the friction, between the free end of the rocker arm and the upper end of the valve stem, it is planned that when the valve is approximately half open that the top of the valve stem be in the same plane as the pin providing the shiftable axis for the lever arm. The fixed axis for the lever arm should also reside generally in this same plane when the valve is approximately half open.

The vertical leg of the rocker arm is raised and lowered by a suitable actuating device connected to the free end of the lever arm, such as via an accelerator pedal and preferably assisted by a hydraulic amplifier associated therewith, so as to cause various portions of the follower sections on the vertical leg of the rocker arm to be presented to the cam as it rotates with respect to the rocker arm. Depending upon the profile of the follower surface sections, the lift and duration of the valve opening can be adjusted by merely raising or lowering the vertical leg of the rocker arm. The profile of one cam follower section can be contoured so as to provide a semi-desmodromic action of the rocker arm, the follower section being sufficiently curved so that after the cam has acted on the rocker arm in a direction to open the valve, further rotation of the cam acts in a direction so as to rock the rocker arm in an opposite direction, thereby relieving the spring associated with the valve of the full responsibility for closing the valve as in the past. Thus, a lighter weight spring can be employed when practicing my invention. Provision is also made for imparting a semi-desmodromic action against the valve itself, so as to mechanically force the valve toward its closed position.

Adjacent each side of the cam are eccentric and ramp portions which act on appropriately profiled additional or auxiliary follower surfaces situated adjacent each side of the main follower surface. The cam and the flanking eccentric and ramp portions are preferably integral with each other, forming a single cam unit. The ramp portions, however, are angularly oriented with respect to the cam and act on the additional or auxiliary follower surfaces adjacent the main follower surface so as to cushion the opening and closing of the valve during various load conditions, these ramp portions having the greatest effect under light and moderate loads. However, under heavy loads, that is, maximum lift, the ramps associated with the major cam lobe take over. Different profiles can be given to the various eccentric and ramp portions in order to achieve desired valve opening and closing patterns.

DESCRIPTION OF THE PREFERRED EMBODIMENT

Figure 1:
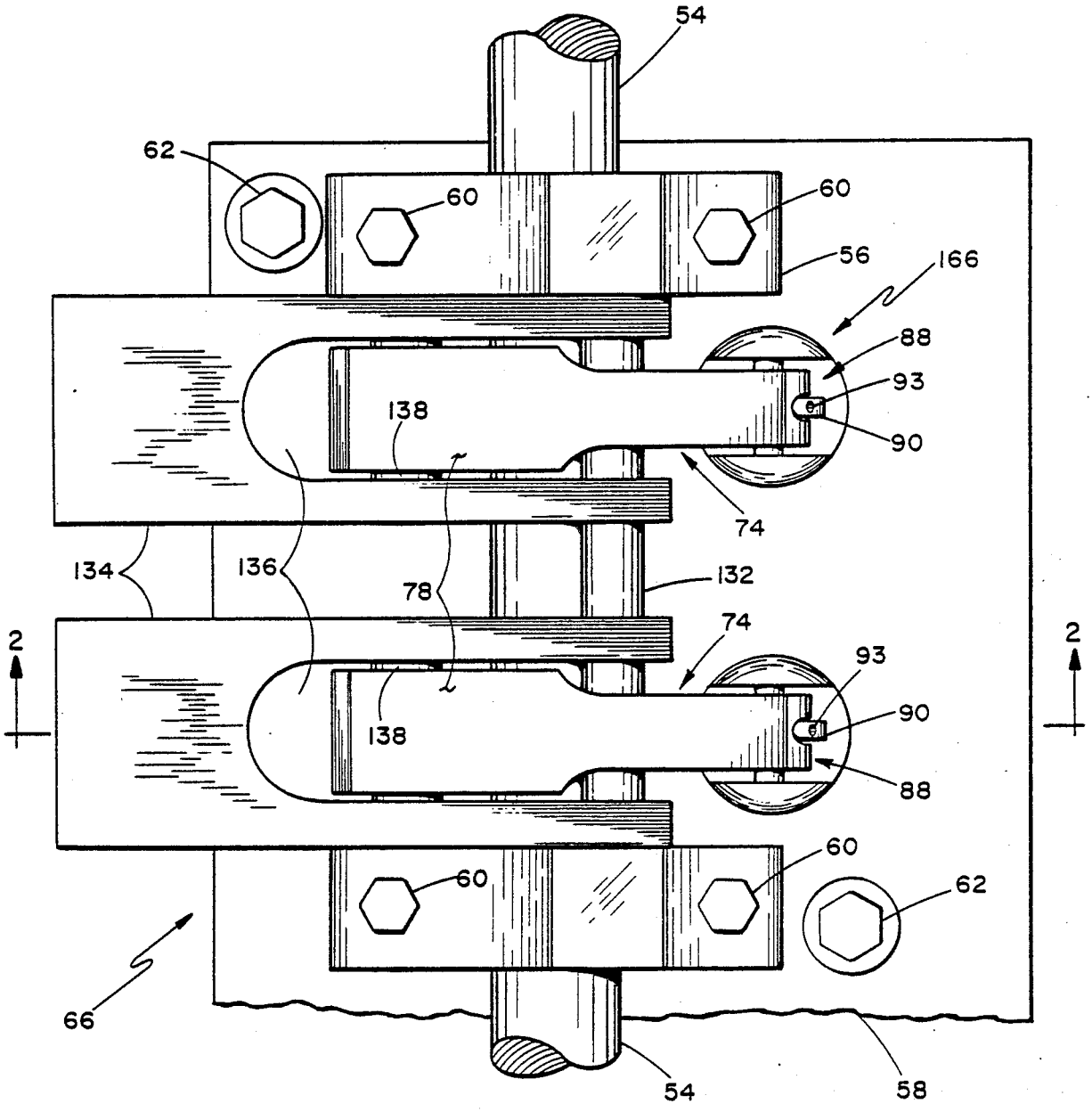
FIG. 1 is a top plan view of two valve control mechanisms exemplifying my invention, one mechanism being associated with the intake valve of an internal combustion engine cylinder and the other with the exhaust valve of such cylinder.

Referring now to the drawings, a conventional internal combustion engine 10 has been fragmentarily illustrated. The engine 10 includes an engine block 12 containing a combustion cylinder or chamber 14 therein, only the upper portion thereof appearing in FIG. 2 and being but one of any number of such cylinders. Reciprocal within the combustion chamber 14 is the usual piston. Being conventional, it is not thought necessary to illustrate the piston, the piston rod or the crankshaft. Overlying the cylinder block 12, however, and secured thereto is a cylinder head 18.

It will be discerned that there is a valve port 20 formed in the lower side of the cylinder head 18 by reason of a downwardly facing beveled seat 22. The valve port 20 constitutes an intake opening, a pasage 24 extending to the opening or port 20 from the intake manifold (not shown) of the engine 10.

Also conventionally included is a reciprocable intake valve 26 having a valve head 28 at its lower end, the valve head 28 being beveled at 30 so as to seat against the beveled seat 22. Extending upwardly from the head 28 is a stem 32.

A coil spring 34 encircles the upper portion of the valve stem 32, the lower end of this spring bearing against the cylinder head 18. As the description progresses, it will become clear that the spring 34 can be a lighter weight or weaker spring than normally used to close an internal combustion engine valve. Located at the upper end of the stem 32 is a spring retainer denoted generally by the reference numeral 36, the retainer 36 including a sleeve 38 formed with a tapered bore 40. Within the bore 40 are a pair of clips 42 (FIG. 12) provided with an arcuate shoulder 44 that extends into an annular groove 46 formed in the stem 32. The retainer 36 also includes an integral boss 48 integral with its underside that extends into the upper end of the coil spring 34. In this way the spring 34 is held captive between the cylinder head 18 and the retainer, and acts to normally urge the reciprocable valve 26 into its closed position; see FIGS. 2 and 3 for instance. The retainer 36, in addition to one end of the spring 34 assists in the realization of two other functions, the descriptions of which functions are better reserved for later reference.

The engine 10 additionally includes a camshaft 54 journaled for rotation in bearings 56. There are, of course, an appropriate number of bearings, two bearing blocks 56 appearing in FIG. 1, so that the camshaft 54 is adequately journaled for rotation. The various bearing blocks 56, in actual practice, would be appropriately attached to the cylinder head 18. However, in the illustrated instance, the bearing blocks 56 are mounted on an overlying base plate 58 by means of bolts 60, the base plate 58 being attached to the head 18 by means of additional bolts 62. The camshaft 54, it will be understood, is driven by the crankshaft (not illustrated) of the engine 10, the camshaft 54 having whatever number of cam units thereon (to be presently described in detail) that are needed for the number of cylinders or combustion chambers 14 that the particular engine 10 has. The camshaft 54, as is conventional, is driven at half the rotative speed of the crankshaft.

Obviously, each cylinder or combustion chamber 14 would also have an exhaust valve associated with it, and for the sake of completeness an exhaust valve, even though not visible (as is valve 26) is indicated at 126 in FIG. 1. It is not thought necessary, however, to further refer to the valve 126 other than to mention that its construction is similar to the valve 26; only its function is different.

My mechanism for controlling the valve 26 has been denoted in its entirety by the reference numeral 66. Included in the mechanism 66 is a specially configured cam unit or cam assembly indicated generally by the reference numeral 68.

Only one such cam unit 68 need be shown in order to illustrate my invention. To facilitate a discussion hereinafter made, it will be well at this time to identify one of the several cam components of the cam unit 68. In this regard, the cam unit 68 may be described as including a central or main cam 70 formed with a lobe portion 70*a*, a base circle portion 70*b*, and connecting ramp portions 70*c* and 70*d*. It will be appreciated that the ramp portion 70*c* progresses smoothly and radially outward from the base circle portion 70*b* to the lobe portion 70*a*; conversely, the ramp portion 70*d* decreases radially from the other side of the lobe portion 70*a* back to the same radius as the base circle portion 70*b*.

Figure 28:
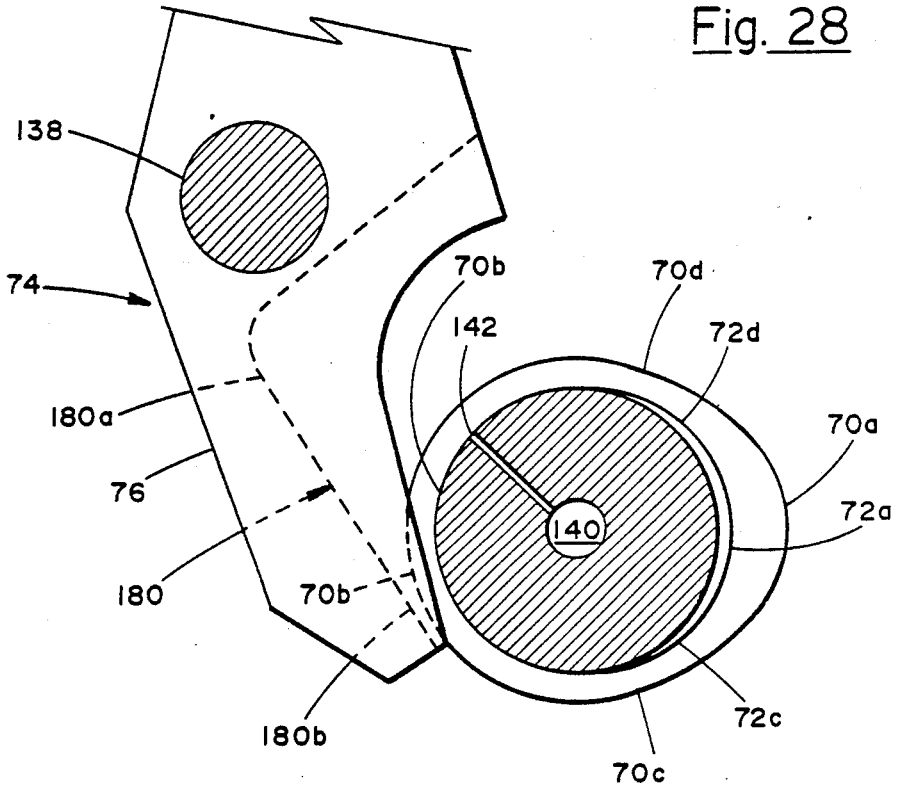
FIGS. 28 and 29 show the negative or reverse inclination of FIGS. 26 and 27 under full load conditions.
Figure 29:
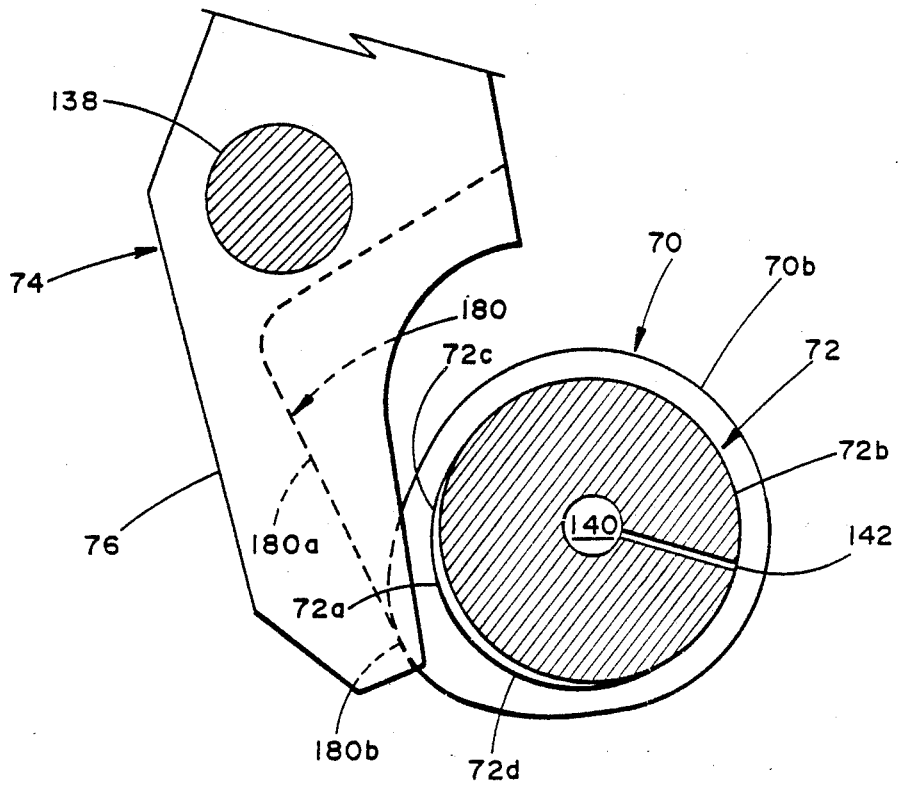

Although shown and described more fully in my continuation application, Ser. No. 622,038, filed June 22, 1984, reference will now be made to a second cam 72 that is adjacent the cam 70. Actually, there are two second cams, one to either side of the cam 70. Although FIGS. 28 and 29 depict differently profiled cams corresponding to the cams 72, it will simplify the description at this stage to consider the cams 72 as replicas of each other. Therefore, the contour of only one cam 72 need be described. In this regard, it will be noted that the cam 72 has an eccentric portion 72*a*, a base circle portion 72*b* and ramp portions 72*c* and 72*d*. Owing to its increasing radius, the portion 72*c* functions as a take-up or opening ramp, whereas the portion 70*d* functions as a give-up or closing ramp because of its decreasing radius, both coacting with cam follower surfaces yet to be described. However, it is to be understood that the ramp portions 72c, 72d belonging to the cam 72 are angularly oriented in a predetermined manner with the ramp portions 70c, 70d belonging to the cam 70; this relationship will be better understood as the description progresses.

The valve mechanism 66 further comprises an L-shaped rocker arm 74 having a substantially vertical leg 76 and a substantially horizontal leg 78. The rocker arm is mounted for pivotal or rocking movement on a pin (later identified by the reference numeral 138) that is supported in the illustrated case in a manner hereinafter described.

Figure 9:
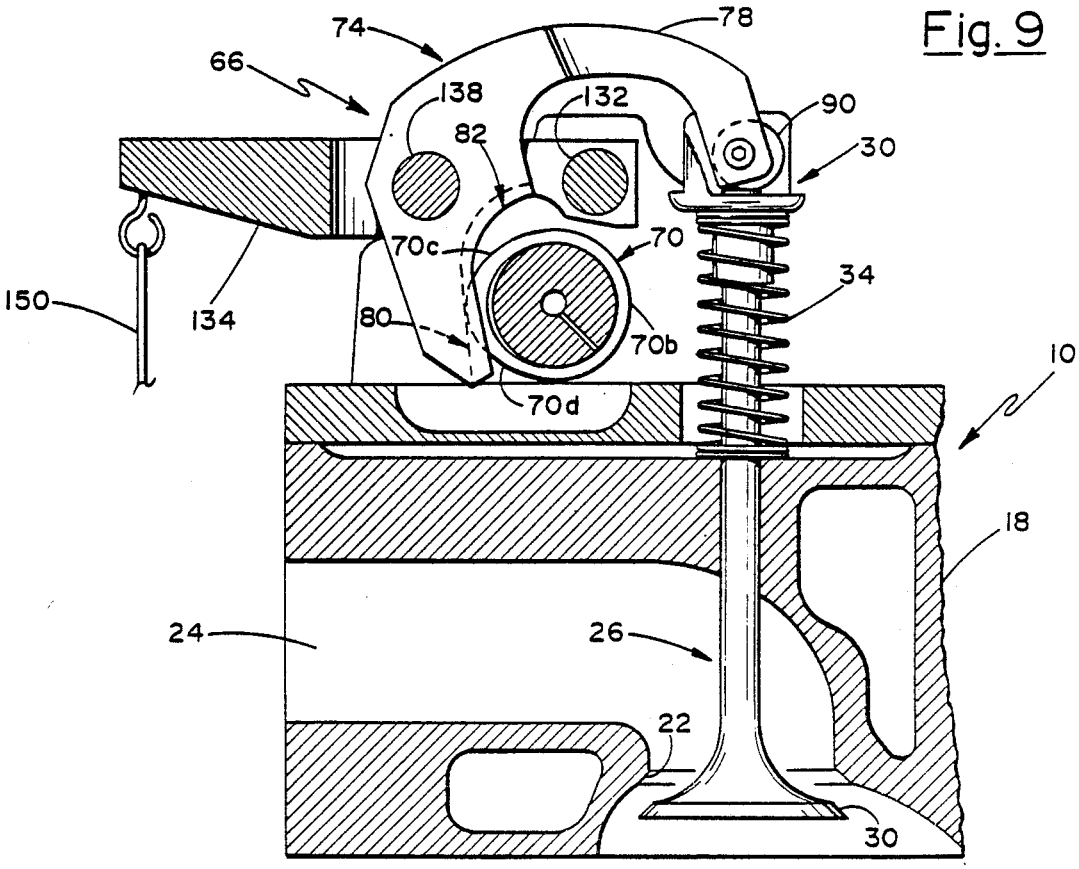
FIG. 9 is a view generally resembling FIG. 5, but depicting a dimensionally modified operating mechanism that provides a reduced amount of wiping friction on the valve stem at various valve openings.
Figure 10:
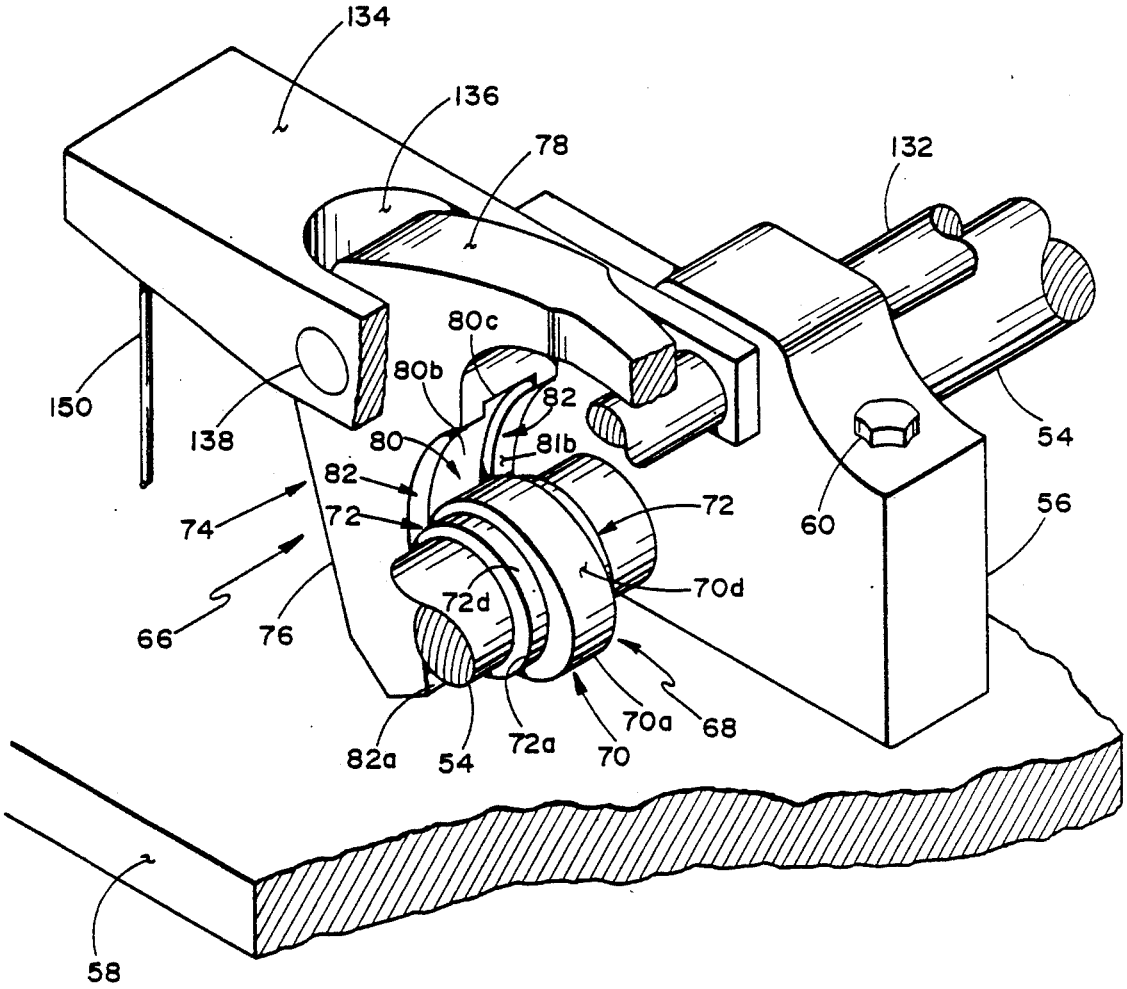
FIG. 10 is a perspective view of my valve control mechanism with portions thereof broken away, the rocker arm and the cam unit (with its more pronounced cams) being in the position in which the corresponding components appear in FIG. 2.

Referring now in detail to the vertical leg 76 of the rocker arm 74, which is shown in a number of the views, it is to be observed, especially from FIG. 10, that it has formed thereon a cam follower surface denoted in its entirety by the reference numeral 80. The surface 80 has in the illustrated instance a linear or straight lower section 80a, an intermediate curved section 80b and an upper curved section 80c; see FIG. 2 for example. The linear or straight lower section 80a, for the sake of description, can be said to possess a positive inclination in FIGS. 2–9, 13–25, 28 and 29. However, a modified section 180a, which will be described in greater detail when considering FIGS. 26 and 27, possesses a reverse or negative inclination. It can be pointed out at this time that the reverse inclination section 180a has been superimposed on FIG. 14 for comparison purposes with the positive inclination section 80a. More specifically, the section 80a is represented by a sequence of short dashes, whereas the section 180a has been represented by a series of alternating short and long dashes.

Figure 26:
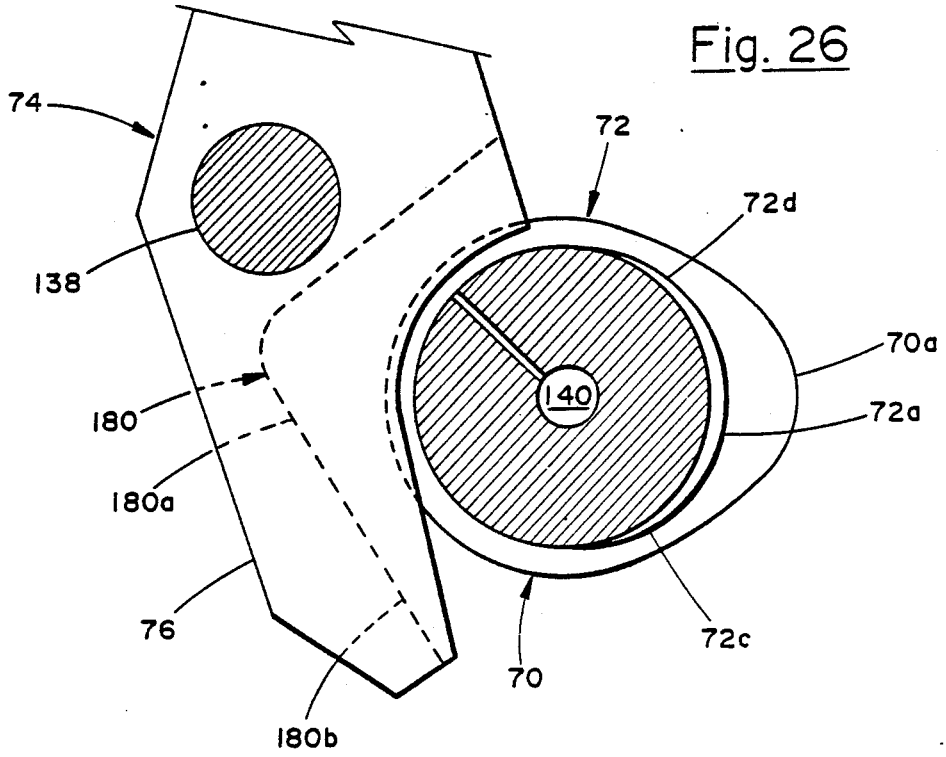
FIGS. 26 and 27 depict a no load condition of my mechanism but with a negative inclination imparted to the rocker arm's cam follower surface.
Figure 27:
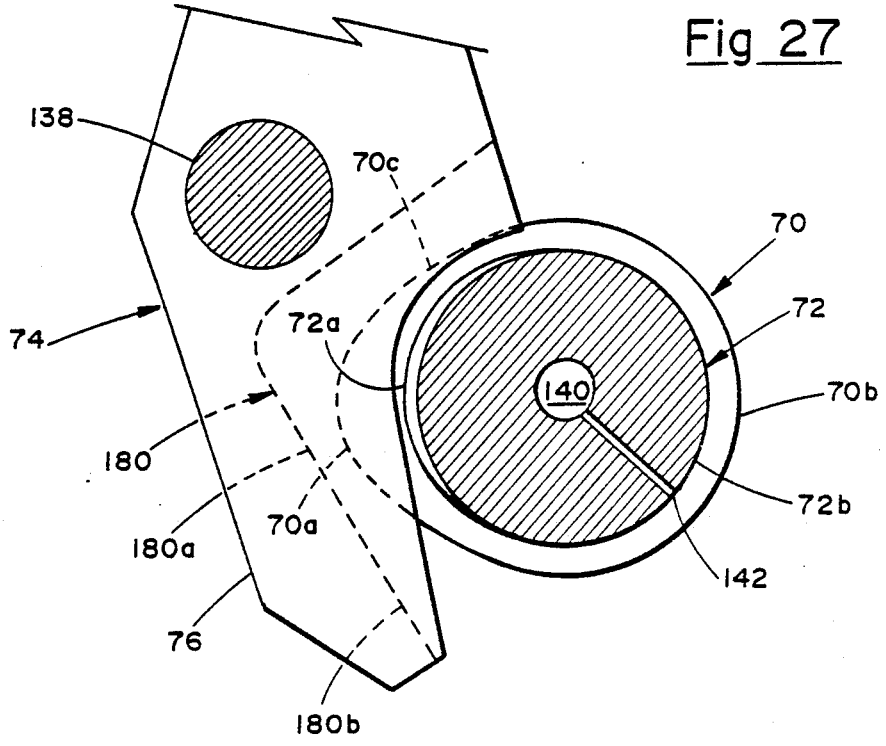

While the reason for the reverse inclination appearing in FIGS. 26 and 27 (and phantomly in FIG. 14) will not be fully appreciated at this particular stage, nonetheless, it can be stated that the reverse inclination can provide an advantage where the rate of opening and closing the valve 26 should be slower so that the engaging forces exerted by the lobe portion 70a when opening the valve 26 will be reduced. As already indicated, this will become clearer as the description progresses. What should be understood at this time, though, is that the cam follower surface 80 comprised of the sections 80a, 80b and 80c are to be engaged and acted on by the lobe portion 70a of the cam 70.

Flanking the follower surface 80 are identically profiled, laterally spaced additional cam follower surfaces 82, each surface 82 being comprised of a generally linear section 82a and two curved sections 82b and 82c. Stated somewhat differently, the surface 82 is formed on spaced parallel flanges 84 extending perpendicularly away from the follower surface 80, the flanges 84 forming a channel or groove with the follower surface 80, which constitutes the base of such a channel or groove, as best perceived in FIG. 10. At this stage, though, it can be pointed out that the surfaces 82, actually narrow enough to be called edges, are intended to be engaged by the portions 72a, 72b, 72c and 72d of the cams 72, the particular section 82a, 82b or 82c that is engaged depending upon the position of the rocker arm 74. This action will be better understood hereinafter.

As far as the horizontal leg 78 of the rocker arm 74 is concerned, it is considerably simpler in shape than the vertical leg 76. The horizontal leg 78 is actually curved or arched to provide clearance with respect to a shaft yet to be referred to. It is not channeled or grooved, however, as the vertical leg 76 is. The horizontal leg 78 as a bifurcated, downwardly depending nose or nub 86 providing portions 86a, 86b at its free end, the nose or nub 86, however, in my said copending application Ser. No. 491,819, now U.S. Pat. No. 4,495,902, bearing directly against the upper end of the valve 26. In the present situation, though, the nose or nub 86 carries a device indicated generally by the reference numeral 88 for adjusting the amount of lash and the amount of desmodromic action. The device 88 is shown best in FIGS. 11 and 12, although it appears in other views as well.

The device 88 includes a rotatably adjustable disc or wheel 90 having an eccentrically disposed peripheral surface 92 provided with a radial hole 93 via which the disc 90 can be rotatively adjusted. The disc 90 has an axially offset opening 94 through which the cylindrical shank 96 of a bolt 98 extends, the bolt 98 having a head 100 formed with a hexagonal socket 102 thereon for the insertion of a socket wrench (not shown). The cylindrical shank 96 also extends through circular apertures 104 provided in the bifurcated nose or nub portions 86a, 86b of the horizontal leg 78. The end of the shank 96 is tapped for the threaded accommodation of a second bolt 106 having a threaded shank 108 and a disc or head 110 formed with an eccentric periphery 112. A hexagonal socket 114 enables the head 110 to be twisted by means of a socket wrench (not shown).

Whereas the head 100 of the bolt 98 projects into an aperture 116 formed in an upstanding leg 118 integral with the retainer 36, thereby rendering its socket 102 accessible, the head 110 extends into an aperture 120 formed in a second upstanding leg 122 also integral with the retainer 36. The aperture 120 does more than provide access to the socket 114; owing to the eccentric periphery 112 of the head 110, it can be adjusted within the aperture 120 to determine the amount of desmodromic action. The functions performed by the device 88 will be dealt with hereinafter.

Describing now the manner in which the rocker arm 74 is mounted, attention is first directed to a shaft 132 providing a fixed axis, the shaft 132 being held by means of the bearings 56 that are fixedly attached to the base plate 58 (which in turn is fixedly attached to the cylinder head 18, as earlier mentioned). Pivotally mounted on the shaft 132 is a lever arm 134, the rocker arm 74 extending through a slot 136 in the lever arm 134. A pin 138 extends through the lever arm 134 and the portion of the rocker arm 74 residing in the slot 136 through which the rocker arm 74 passes. In this way, the lever arm 134 supports the rocker arm 74 for rocking movement about the free end of the horizontal leg having the eccentric disc 90 mounted thereon.

Figure 2:
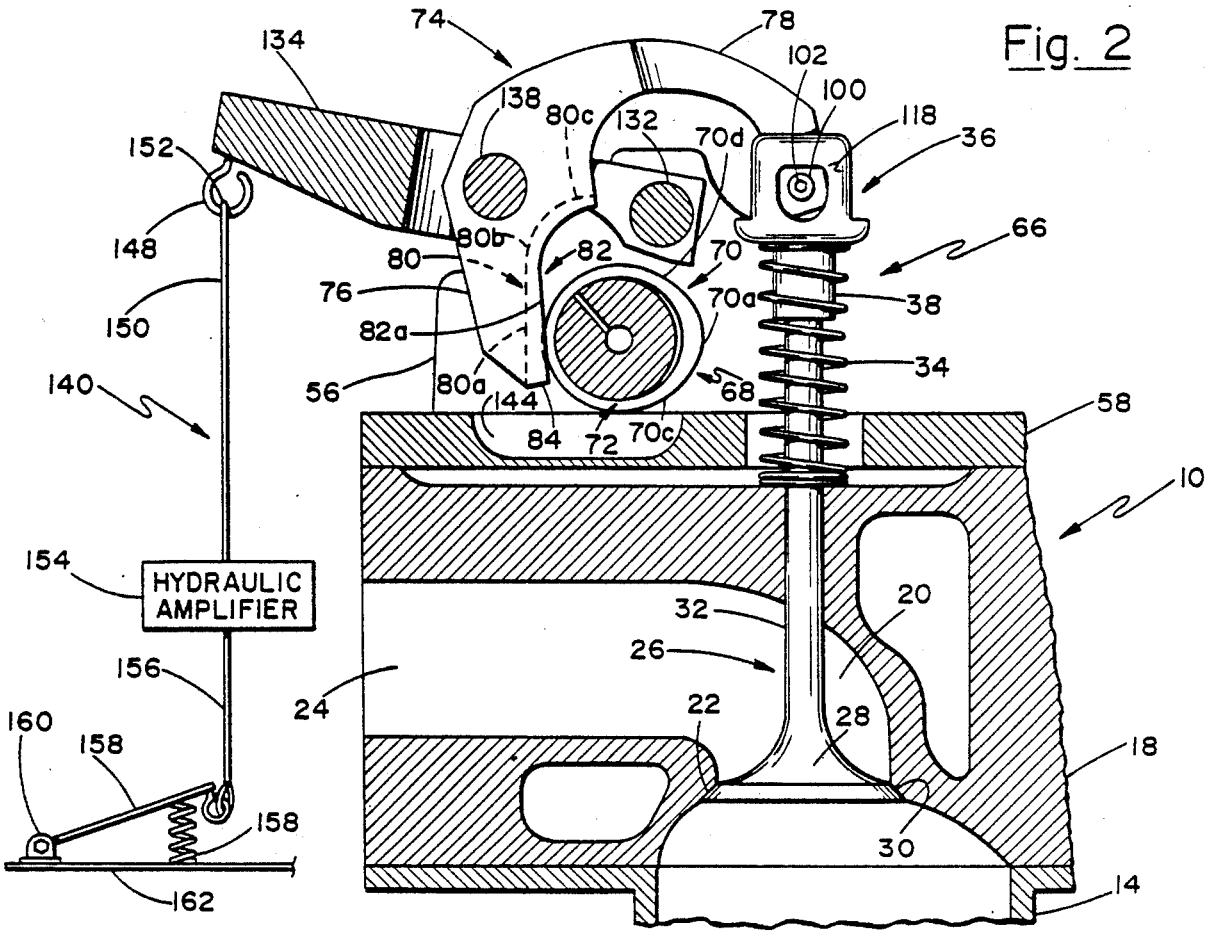
FIG. 2 is a vertical sectional view taken in the general direction of line 2—2 of FIG. 1 for the purpose of illustrating the mechanism associated with the intake valve adjusted for a no load condition, the view showing the cam unit at its three o'clock position and the valve closed.

More specifically, when the lever arm 134 is actuated in a counterclockwise direction, as viewed in FIG. 2 and other similar figures, the vertical leg 76 of the rocker arm 74 is moved downwardly so as to present various portions of the cam follower surface 80 to the cam unit 68 as the cam unit 68 rotates, the cam unit 68 rotating when the camshaft 54 is rotated. By the same token, when the lever arm 134 is pulled farther downwardly, another portion of the cam follower surface 80 is brought into juxtaposition with the cam unit 68. Stated somewhat differently, owing to the rocked condition of the rocker arm 74, various portions of the sections 80a, 80b and 80c are brought (for various load conditions) into position so as to be engaged by the cam unit 68 as it rotates in a clockwise direction as viewed in the various figures herein presented.

The manner in which my mechanism 66 is lubricated is important, especially from a practical standpoint. In this regard it is planned that the camshaft 54 be tubular so that lubricant can flow axially through its bore 140 and then outwardly through a radial passage 142 formed in the cam unit 68. While some of the oil impinges onto the cam follower surface 80 and/or the surfaces 82 of the rocker arm 74, there is a shallow trough or reservoir 144 provided in the base plate 58 that collects the oil so that the lobe portion 70*a* belonging to the cam 70 can dip into the collected oil as the cam unit 68 rotates, thereby enhancing the lubrication of my mechanism 66. It is also intended that the lower end of the rocker arm's vertical leg 76 dip into the reservoir 144 as can be discerned from FIGS. 6 and 7. The reservoir 144 with the residual oil therein becomes extremely valuable in providing lubrication during the first few revolutions of the camshaft 54 when the engine 10 is first started. More practically speaking, the presence of the reservoir 144 with the residual oil is of considerable benefit during the priming period (that is, when the accelerator pedal is first depressed and before the engine 10 actually starts to rotate), for this reduces the likelihood of the lash changing due to wear over a period of time.

Although other devices can be employed, for the sake of completeness a device indicated generally by the reference numeral 146 is employed for positioning the lever arm 134, and in turn to position the vertical leg 76 of the rocker arm 74, to produce an optimum relationship with the cam unit 68 so that the cam unit 68 acts on the most appropriate portion of the cam follower surface 80 for the particular load to which the engine 10 is subjected. The device 146 illustratively includes an eyebolt 148 threaded upwardly into the left end of the lever arm 134 as viewed in FIG. 2. A vertical rod 150 extends downwardly from the eyebolt 148, the rod 150 having a hook 152 at its upper end that engages the eye of the eyebolt 148. A hydraulic amplifier or servo mechanism 154, through a link 156, augments the foot force applied to an accelerator pedal 158. The accelerator pedal 158 is pivotally mounted at 160 to the floorboard 162 of the vehicle having the engine 10 therein, a spring 164 biasing the pedal 158 upwardly and away from the floorboard 162.

It is intended that there be one of my mechanisms 66 associated with each valve of an internal combustion engine 10, particularly each intake valve, such as the intake valve 26. Inasmuch as an exhaust valve 126 has been phantomly indicated as being present in FIG. 1, the control mechanism therefor has been labeled 166. The mechanism 166 is virtually identical to the mechanism 66, differing mainly in the profile of the cam follower surface 80. Whether associated with an intake valve 26 or an exhaust valve, the amount of valve movement, when practicing the teachings of my invention, can be individually determined for each valve in that a separate mechanism 66 (or 166) may be employed for each valve. It will be understood that the two mechanisms 66, 166, and any other mechanisms for other valves (not shown), would be appropriately interconnected to the positioning mechanism 146 for whatever other mechanism is employed; it would unduly complicate the drawings to illustrate any such interconnecting arrangements and would serve no worthwhile purpose in that the manner of connecting additional mechanisms forms no part of the present invention, even though important as a practical matter.

Having presented the foregoing description, the basic operation of my mechanism 66 should be readily understandable. Nonetheless, a brief explanation should enable one to more fully appreciate the various benefits to be derived from the practicing of the invention. In the initial operational description, it will be assumed that the follower surface 80, more specifically the linear section 82*a*, has a positive inclination imparted thereto. In this regard, the positive inclination appears in FIGS. 2–9, 14–25 and 30, whereas the negative inclination 180, more specifically its linear section labeled 180*a*, appears in FIGS. 26–29 plus FIG. 14 (by reason of it being superimposed on this figure for facile comparison with the positive inclination 80*a*). It is only necessary that it be recognized that the two inclinations can be electively utilized when practicing my invention. However, at this time it will be assumed that the rocker arm 74 has only the positive inclination thereon; a description involving the negative inclination will be given thereafter.

FIG. 2 shows the cam unit 68 in a three o'clock position. Thus, the cam lobe 70*a*, when in this angular position, is not acting on any portion of the cam follower surface 80; consequently, the valve member 26 by reason of the spring 34 is closed, the spring 34 biasing the head 28 upwardly so that it seats against the beveled seat 22.

Figure 14:
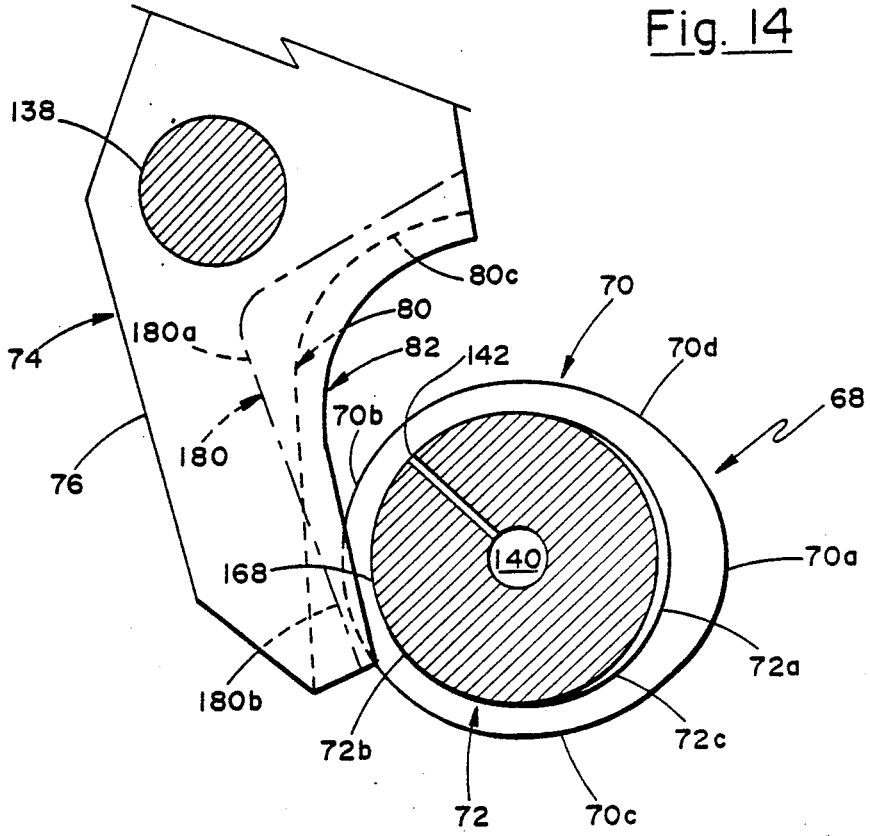
FIGS. 14 and 15 are enlarged fragmentary no load views of the rocker arm and cam correlated with certain data set forth in FIG. 13.

Close inspection of FIG. 2, and also inspection of FIG. 10 where the cams 72 have their contours outwardly of the camshaft 54 in order to make the role performed by the cams 72 more readily apparent, will reveal that the laterally spaced follower surfaces 82, more specifically, the straight sections 82*a* thereof, are angularly aligned with the base circle portion 72*b* of each cam 72 and that the eccentric ramp portions 72*c*, 72*d* are ineffectual when in the angular position in which they appear in FIGS. 2 and 14.

The clearance at 168 between the base circle portion 72*b* and the surface or edge section 82*a* constitutes the lash. It will later be more completely explained that the device 88 is utilized in adjusting and determining the lash. For the moment it need only be stated that the lash has been adjusted to be on the order of 0.020 inch and that the clearance shown in FIG. 14 at 168 (although present in other figures) represents that amount. The graph constituting FIG. 13 also illustratively makes use of this same amount of lash.

Figure 3:
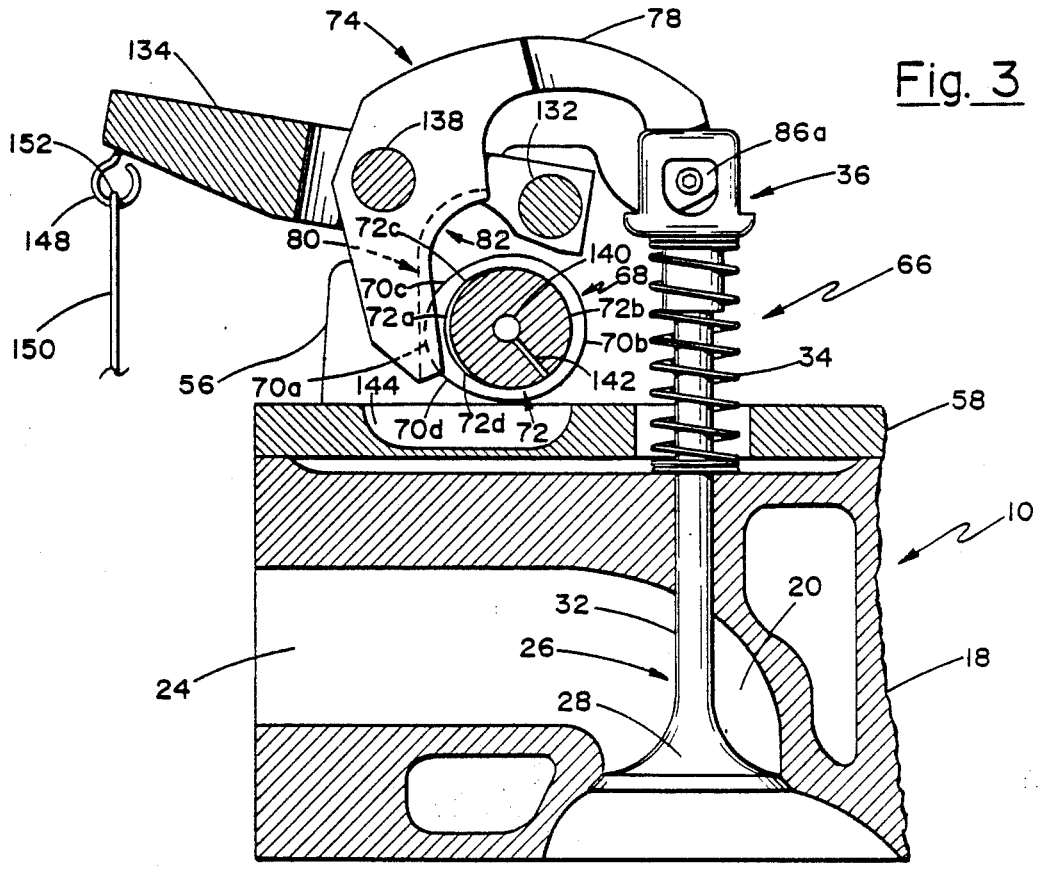
FIG. 3 is a vertical sectional view similar to FIG. 2 in that the valve control mechanism is still in a no load condition but with the cam unit rotated through 180° into a nine o'clock position with the valve still closed because of the no load condition for which the mechanism has been adjusted.
Figure 4:
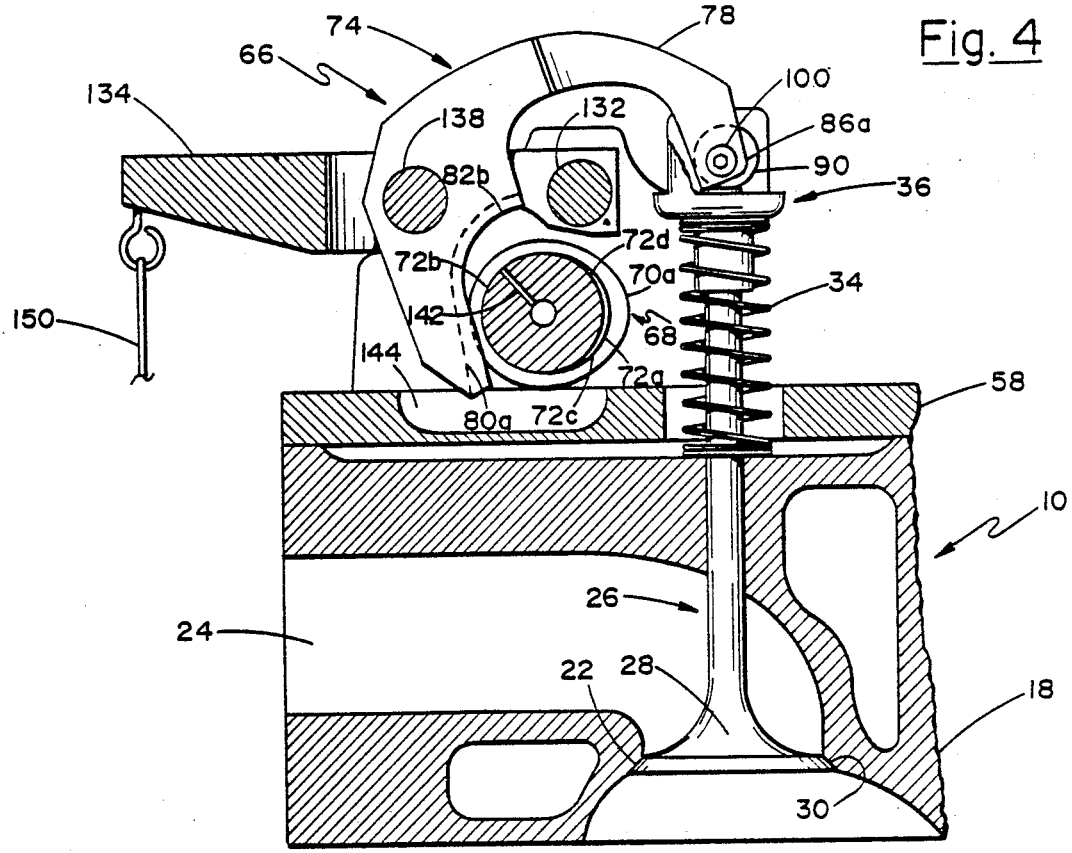
FIG. 4 is a view of my mechanism with the rocker arm in this view adjusted for a partial load condition, the valve, however, being closed in that the cam unit is in its ineffectual three o'clock position.
Figure 5:
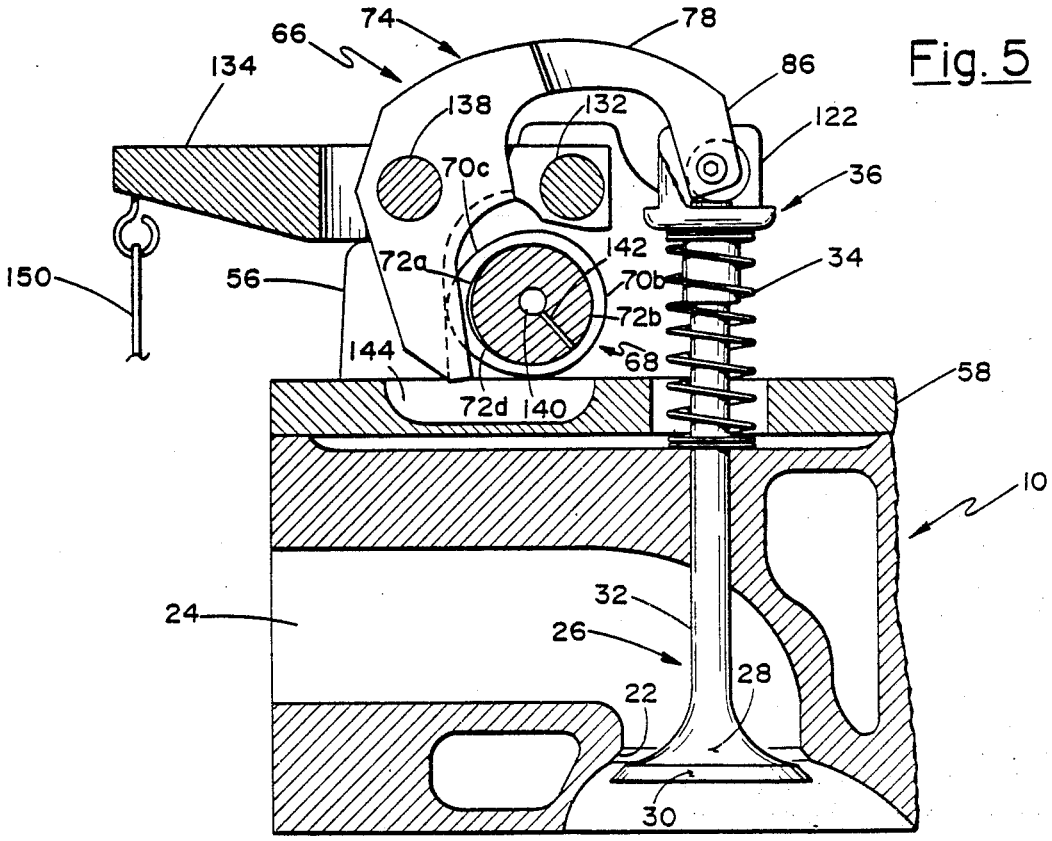
FIG. 5 is a view corresponding to FIG. 4 but with the cam unit in a nine o'clock position so as to actually engage the rocker arm and open the valve part way.
Figure 15:
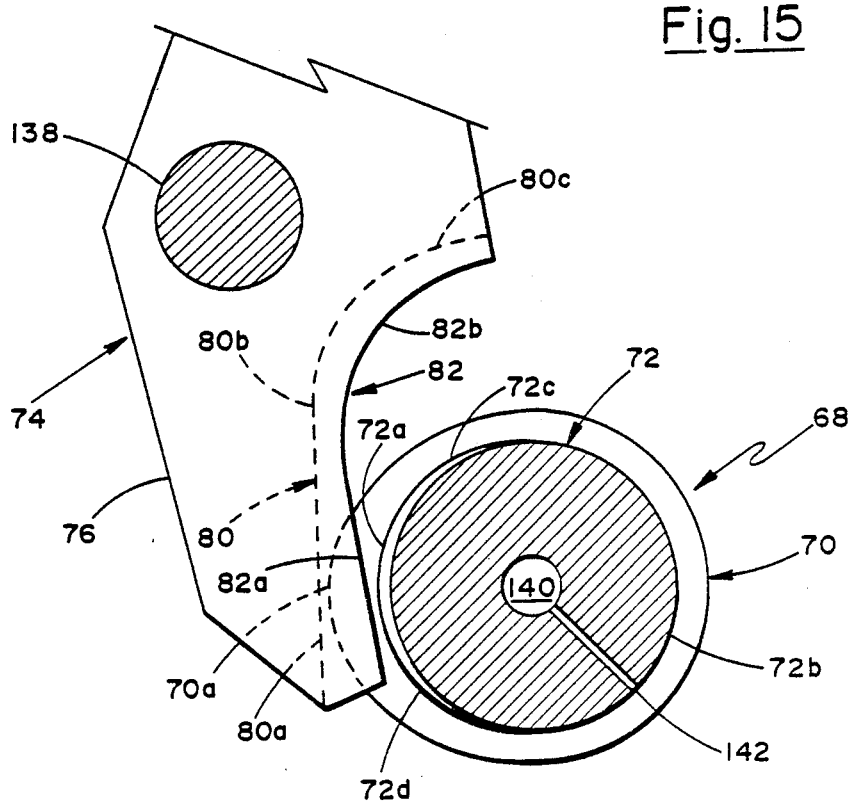

As the cam unit 68 rotates in a clockwise direction from the three o'clock position depicted in FIG. 2 toward the nine o'clock position appearing in FIG. 3, the eccentric portion 72*a* of the cam 72, which is of maximum eccentricity, takes up the clearance that existed between the portion 72*b* and the edge section 82*a*, doing so when the eccentric portion 72*a* moves into registry with the section 82*a* of the edge 82. Since the lash has been adjusted via the device 88 to equal the amount of eccentricity, the lash at this time has been reduced to substantially zero by reason of the eccentric portion 72*a* reaching the straight edge section 82*a*. In other words, the straight section 82*a* at this time becomes tangent to the eccentric portion 72*a*. However, because there is no action of the eccentric portion 72*a* against the straight edge section 82*a*, the rocker arm 74 is not rocked at all. This condition is portrayed in FIGS. 3 and 15. It should also be observed from FIG. 15, due to its larger scale, that under these conditions, the lobe portion 70*a* is not engaging the follower surface 80;

hence, the valve 26, although omitted from FIG. 15, remains closed.

Figure 13:
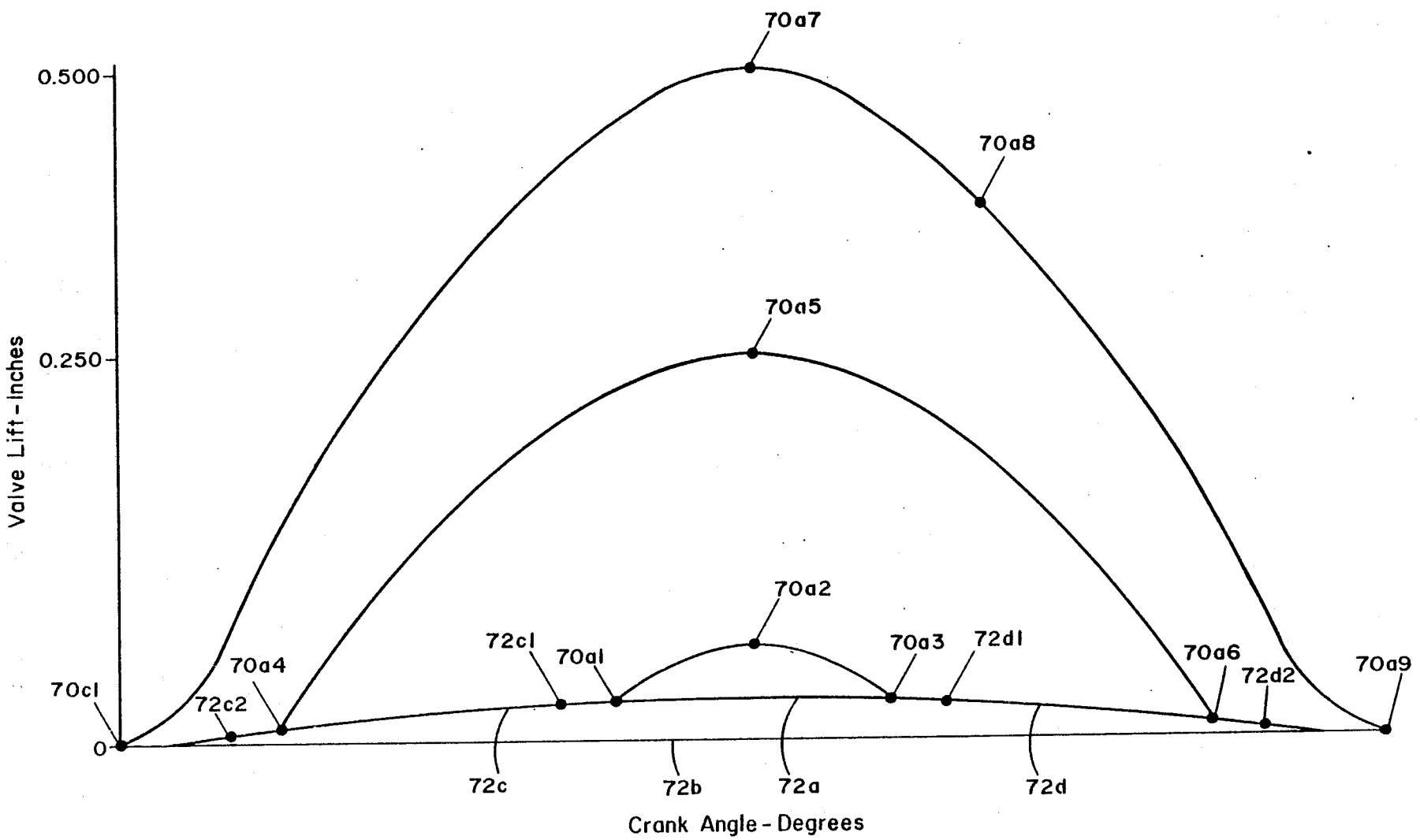
FIG. 13 is a graph with valve lift or opening plotted against crankshaft degrees for the purpose of depicting the changes in valve lift and lash that occur as the rocker arm is moved into various positions to produce different lift conditions.

Although FIG. 13 illustrates other conditions as well, it perhaps will be helpful at this time to observe that the bottom horizontal line represents the base circle portion 72*b* so for the sake of facile comparison this line has been so denoted in FIG. 13 by the reference numeral 72*b*. Still further, the eccentric portion 72*a* is represented, so it, too, has been labeled accordingly, as well as the ramp portions 72*c* and 72*d*. It will be understood that the portions 72*a*, 72*b*, 72*c* and 72*d* are really only relative portions changing in radius; the precise span of each portion need not be specifically delineated in order to understand my invention.

As the cam unit 68 continues to rotate in a clockwise direction from the position in which it appears in FIG. 14, it will be recognized that the eccentric portion 72*a* still is just taking up the clearance or lash that has been deliberately adjusted for, namely, approximately 0.020 inch. Hence, the valve 26 still remains closed, for all that the eccentric portion 72*a* is doing is taking up the lash and not causing the valve 26 to even crack open. During a complete rotation of the camshaft 54, and hence one complete revolution of the cam unit 68, there is no action by the lobe portion 70*a* against any portion of the cam follower surface 80 so the rocker arm 74 remains stationary for the no load condition for which the unactuated foot pedal 158 calls for.

Figure 16:
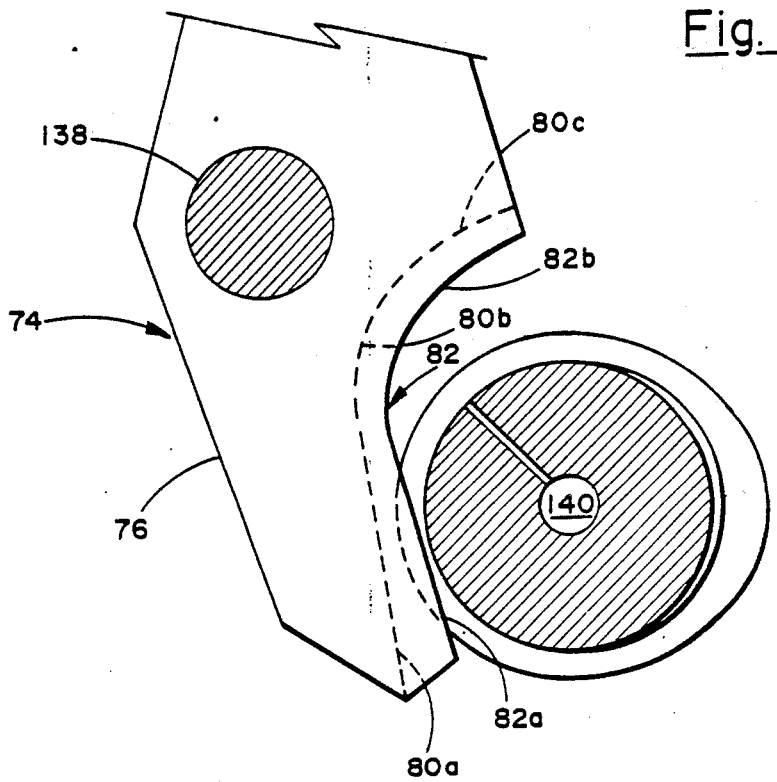
FIGS. 16–18 are fragmentary views illustrating a light load condition, these views also corresponding to certain data appearing in FIG. 13.
Figure 17:
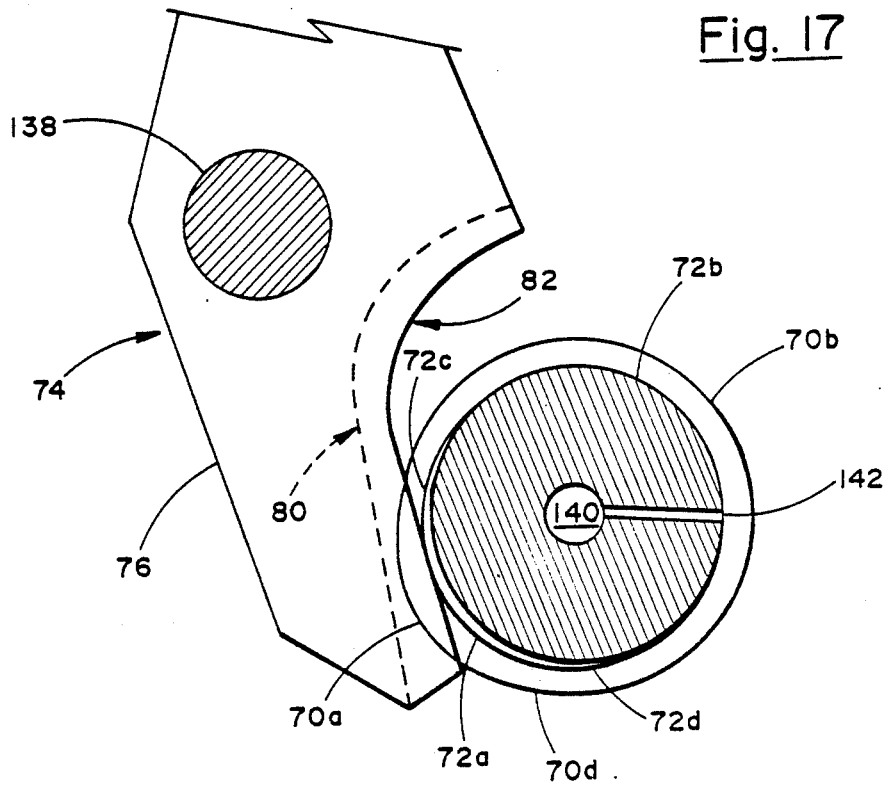
Figure 18:
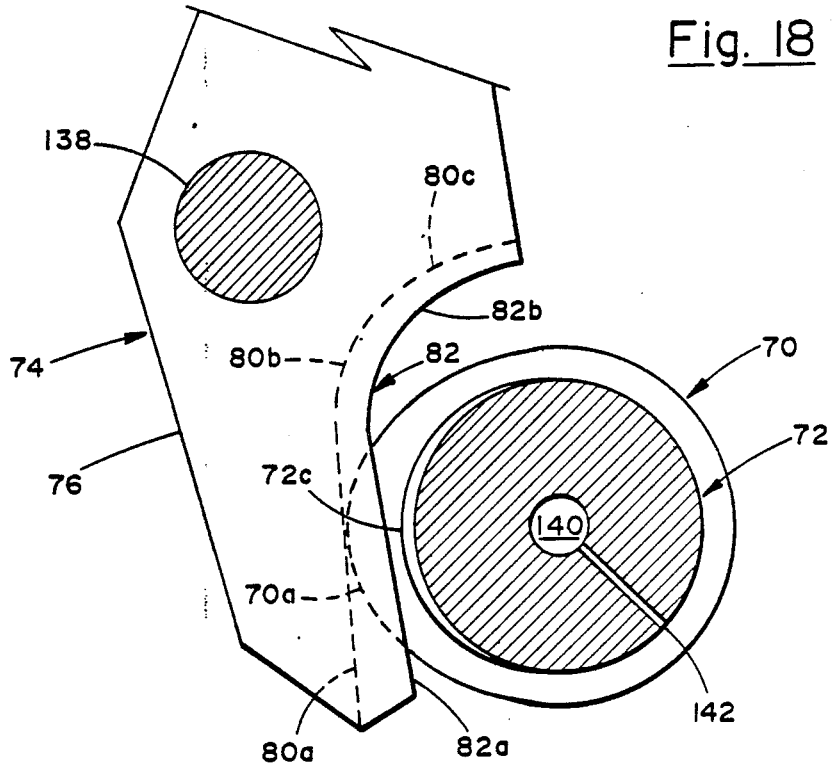
Figure 19:
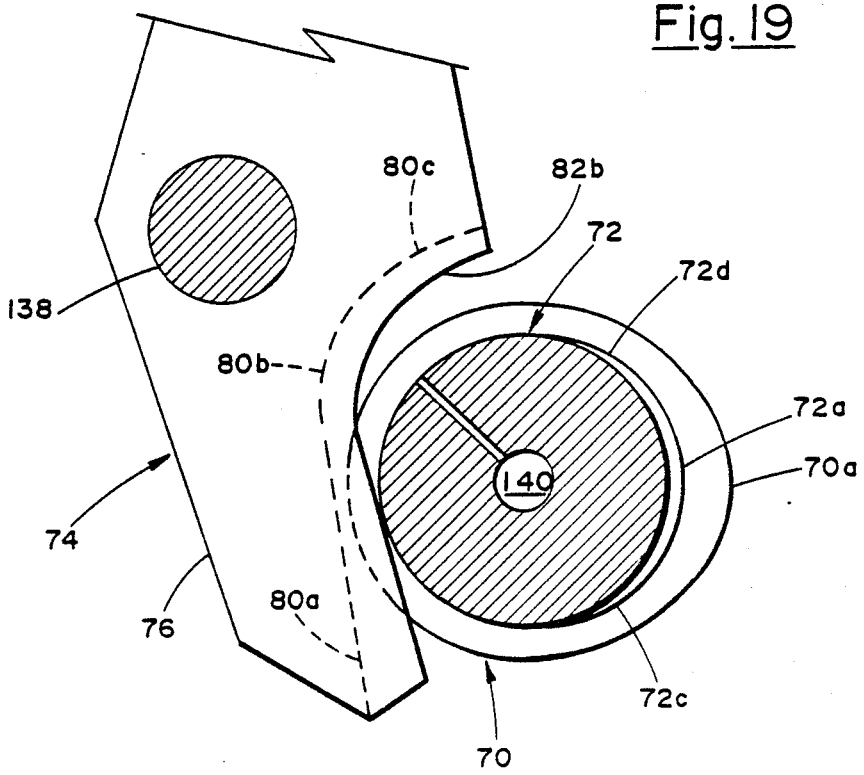
FIGS. 19–22 are fragmentary views depicting a half load condition that is also graphically portrayed in FIG. 13.

Whereas FIGS. 14 and 15 depict my mechanism 66 in a no load condition, FIGS. 16–18 illustrate a light load condition. In FIG. 16, the rocker arm 74 has been rocked slightly in a counterclockwise direction so as to lower somewhat its leg 76 and the cam follower surface 80 formed thereon. Inasmuch as the cam unit 68 is in a three o'clock position, the lobe portion 70*a*, quite obviously, is ineffectual. Close inspection of FIG. 16, though, will reveal that the clearance 168 appearing in FIG. 14 has been slightly decreased by reason of the lowering of the follower surface 80. More specifically, the lowermost portion of the curved section 80*b* has been brought into a position to be engaged by the lobe portion 70*a*.

Attention is now directed to FIG. 17 where the cam unit 68 has been rotated clcokwise through almost 180° (approximately 175°) in which position the take-up ramp portion 72*c* of each cam 72 just touches or contacts the curved section 82*b* of the edge 82 with which it is associated. This contact point has been labeled 72*c*1 in FIG. 13.

As the cam unit 68 rotates from the position in which it appears in FIG. 17 to that shown in FIG. 18, the ramp portion 72*c* acts, starting with the contact point 72*c*1, to crack open the valve 26, for the ramp portion 72*c* increases sufficiently in radius to do so. Thus, the initial valve inertia, and that of the mechanism 66, is overcome before the lobe portion 70*a* engages the follower surface 80. As the cam unit 68 continues to rotate in a clockwise direction, its lobe portion 70*a*, as shown in FIG. 18, just begins to engage or contact the cam follower surface 80, more specifically, the lowermost portion of the curved section 80*b*. This point has been labeled 70*a*1 in FIG. 13.

Assuming for the sake of discussion that the valve 26 is to be opened 0.040 inch or 8.0 percent of its full lift of 0.500 inch, this degree of opening is reached at point 70*a*2 in FIG. 13, which corresponds to the position of the cam 68 as it appears in FIG. 18.

Continued rotation of the cam unit 68 from point 70*a*2 to point 70*a*3 permits the valve 26 to progressively close and results in the lobe portion 70*a* ceasing its engagement with the cam follower surface 80 at point 70*a*3. It is from point 70*a*3 to point 72*d*1 that the ramp portion 72*d* acts to very gradually allow the valve 26 to close, for the ramp portion 72*d* remains in engagement with the curved edge section 82*d* during this period. It is at point 72*d*1 in FIG. 13 that the valve 26 becomes completely closed since the cam unit 68 is in its three o'clock position.

Figure 20:
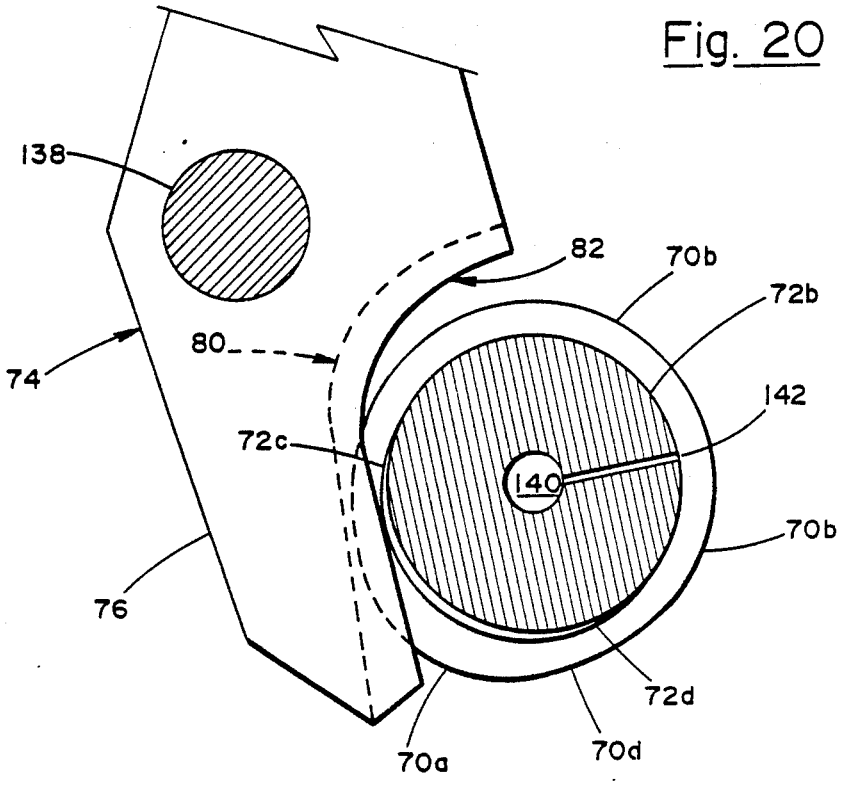

FIG. 20, however, shows the cam unit 68 advanced through 130° at which angle each ramp portion 72*c* is just beginning to engage the curved edge section 82*b* with which it is associated. This contact point has been identified by the reference numeral 72*c*2 in FIG. 13.

Figure 21:
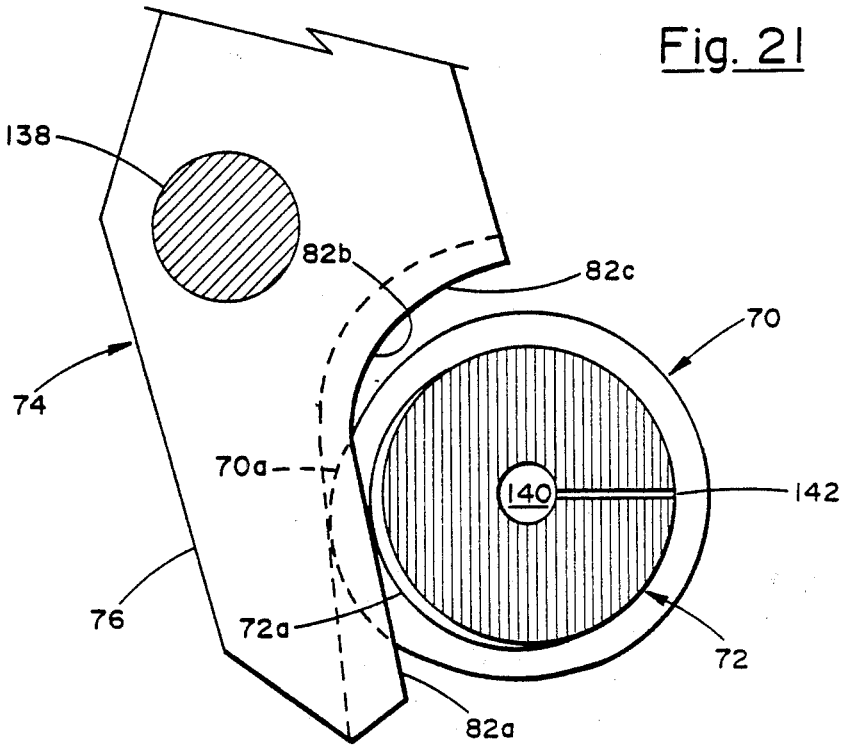

It is the advancement from the just engaged position of the ramp portion 72*c* shown in FIG. 20 to the position thereof in FIG. 21 that the ramp portion 72*c* (actually two in that there is one such portion 72*c* to either side of the cam 70) acts to slightly open the valve 26.

Figure 22:
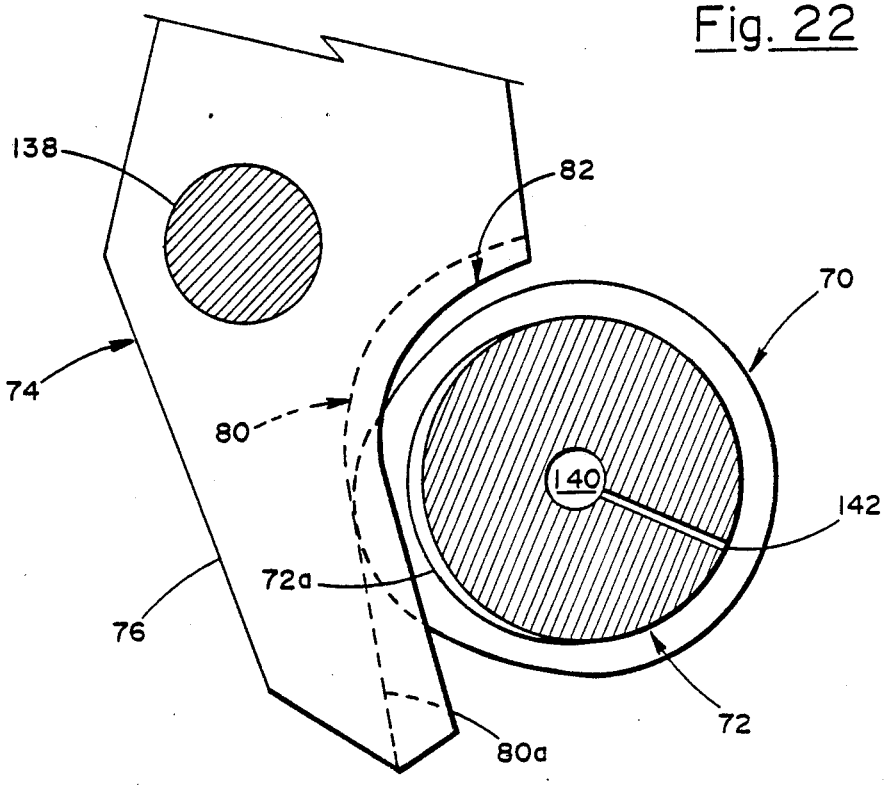

It is when the condition pictured in FIG. 22 is established that the valve 26 becomes half open, this condition being indicated by the reference numeral 70*a*5 in FIG. 13. From then on the valve 26 progressively closes, the rotation of the cam unit 68 allowing this to occur. It is when point 70*a*6 is reached that the lobe portion 70*a* no longer acts on the follower surface 80. However, at point 70*a*6 the valve 26 is not completely closed in that it is held open by the ramp portion 72*d* because it at this time engages the curved edge or follower section 82*b*, there being one such edge section 82*b* at each side of the follower surface 80, as hereinbefore pointed out. Stated somewhat differently, the valve closing action is transferred from the cam lobe 70*a* at point 70*a*6 and the ramp portion 72*d* acts to more gradually allow the valve 26 to close from the moment point 70*a*6 is reached to point 72*d*2, for then the ramp portion 72*d* no longer bears against the edge section 82*b*.

FIGS. 6–8 and 23–25 illustrate a full load condition of my mechanism 66. Of course, the valve 26 remains closed in FIGS. 6 and 23, for the cam unit 68 is in its ineffectual three o'clock position. However, as the cam unit 68 rotates clockwise through virtually 180° into the position of FIG. 24, the ramp portion 70*c* acts against the upper region of the curved follower section 80*b* to start opening the valve 26. This point has been labeled 70*cl* in FIG. 13. It should be appreciated, however, that the eccentric ramp portion 72*c* does not engage any portion of the surface or edge 82 under these conditions. However, the slope of the ramp portion 70*c* is quite gradual, in contradistinction to the slope of the lobe portion 70*a*, so the valve 26 opens relatively gradually. In this regard, the opening pattern does not differ from a conventional camshaft lobe design.

Figure 7:
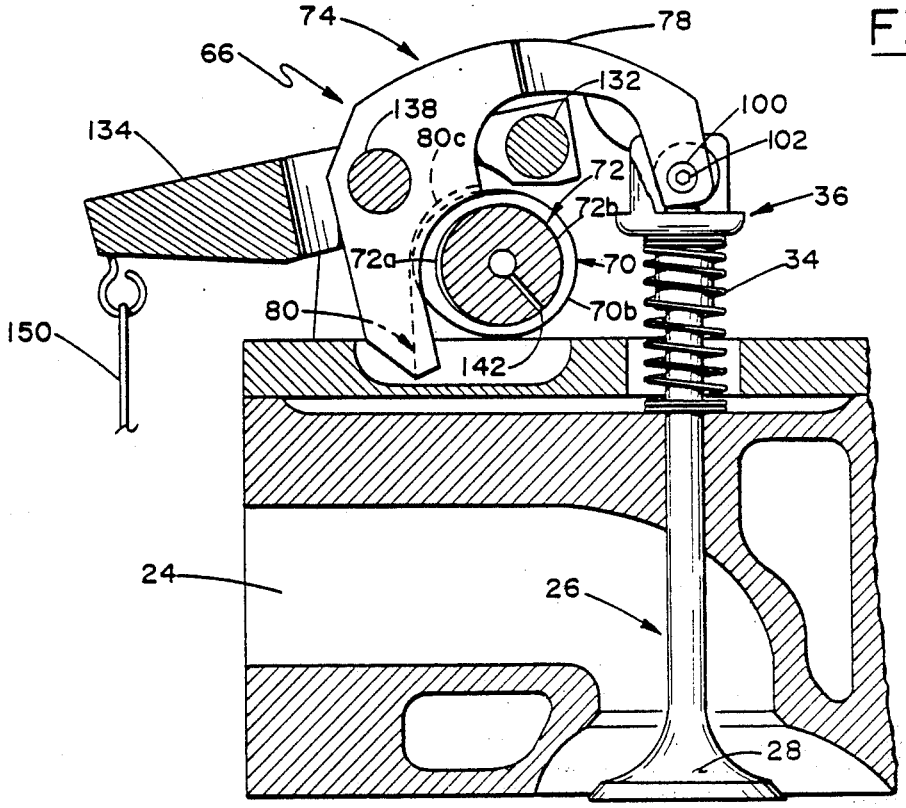
FIG. 7 is a view of my mechanism adjusted for a fully open condition, as in FIG. 6, but with the rocker arm actuated by the nine o'clock position of the cam unit to fully open the valve.
Figure 24:
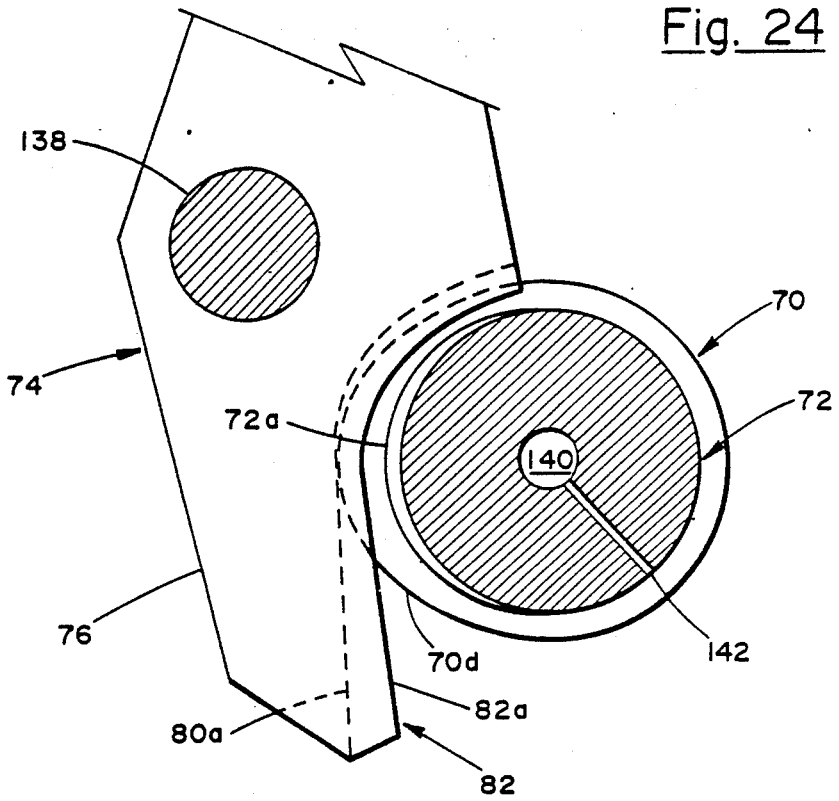

As the cam unit 68 continues to rotate, the valve 26 is progressively opened until the condition in FIGS. 7 and 24 is established. This condition is graphically represented by the reference numeral 70*a*7 in FIG. 13.

Figure 8:
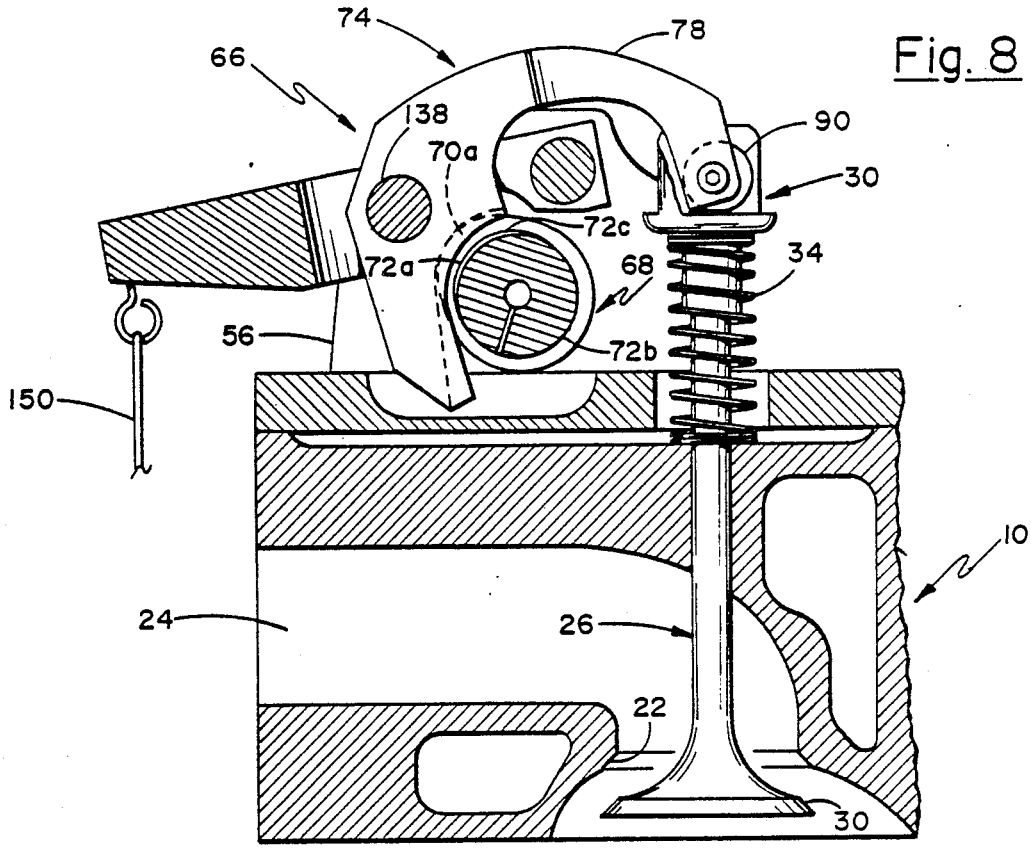
FIG. 8 is a view of the mechanism with the cam unit rotated past the nine o'clock position of FIG. 7 and with the valve still open, the view illustrating the opposite or desmodromic force being applied to the rocker arm.
Figure 25:
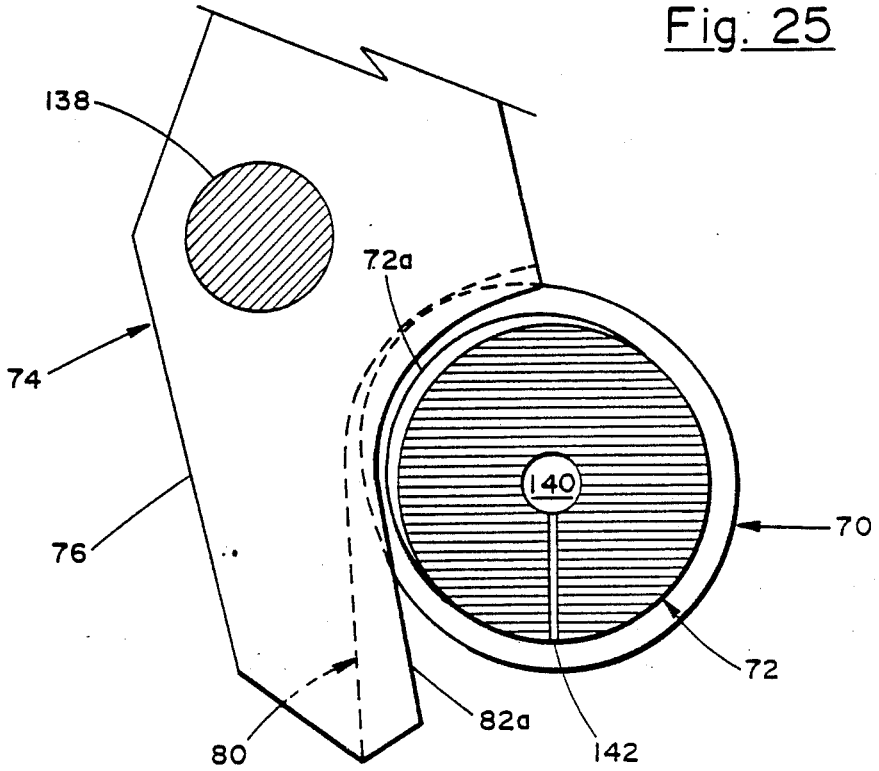

Additional rotation of the cam unit 68 causes its lobe portion 70*a* to engage the upper curved section 80*c* of the cam follower surface 80, as illustrated in FIGS. 8 and 25, with the consequence that the rocker arm 74 is caused to rock or pivot about the pin 138 in a counterclockwise direction, a direction opposite to the clockwise direction that forces the valve 26 open. This constitutes a desmodromic action involving only the rocker arm 74 that prevails for a portion of the arm's rocking movement. The raising of the free end of the rocker arm's horizontal leg 78 immediately removes the valve-opening force that has been applied by virtue of the engagement of the lobe portion 70*a* with the curved section 80*b* of the cam follower surface 80. In a sense, this allows the valve 26, although fully open, to "float". However, due to the coil spring 34 now being able to expand, the spring 34 acts to start closing the valve 26.

The spring 34 acts alone in closing the valve 26 unless the spring 34 is unable to overcome the existing inertia. If the valve 26 is "floating", the eccentric periphery 112 of the disc or head 110 of the device 88 soon engages the top edge of the aperture 120. From then on the head 110 raises or closes the valve 26 because of the now positive engagement of the head 110, more specifically its eccentric surface 112, with the leg 122 of the spring retainer 36. Because the retainer 36 is fixedly attached to the valve stem 32 (by means of the clips 42 appearing in FIG. 12), the valve 26 is lifted in a closing direction.

It is important to understand that until the head 110 engages that portion of the leg 122 thereabove, only the rocker arm 74 is rocked, which constitutes a desmodromic action involving only the rocker arm 74 during a certain portion of the rocker arm's movement. It is when the rocker arm 74, owing to the engagement of the head 110 with the leg 122, that a desmodromic action involving both the rocker arm 74 and the valve 26 takes place. The thus established overall desmodromic action continues until the cam lobe 70*a* rotates past the curved follower section 80*c*. The valve head 28, more specifically, its beveled edge 30, does not engage the beveled seat 22 until the lobe portion 70*a* has passed the section 80*c*; in other words, the spring 34 exerts the final closing force. The angle through which the entire desmodromic action transpires is between the point 70*a*7 in FIG. 13 and the point 70*a*8. The spring 34 supplies the closing force between the point 70*a*8 and the point 70*a*9. Consequently, the desmodromic action occurs at a time when the valve 26 is "floating", which is when a lighter valve spring would normally be incapable of closing the valve fast enough.

Figure 6:
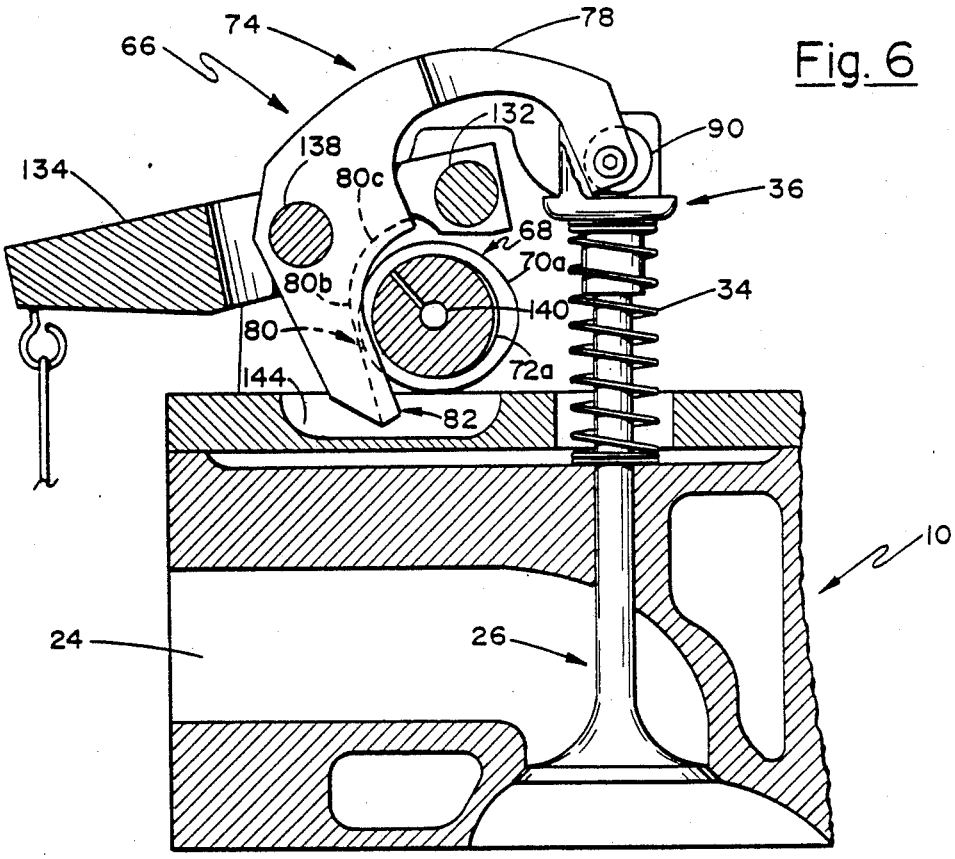
FIG. 6 is a view with the valve closed but the rocker arm conditioned to fully open the valve.
Figure 23:
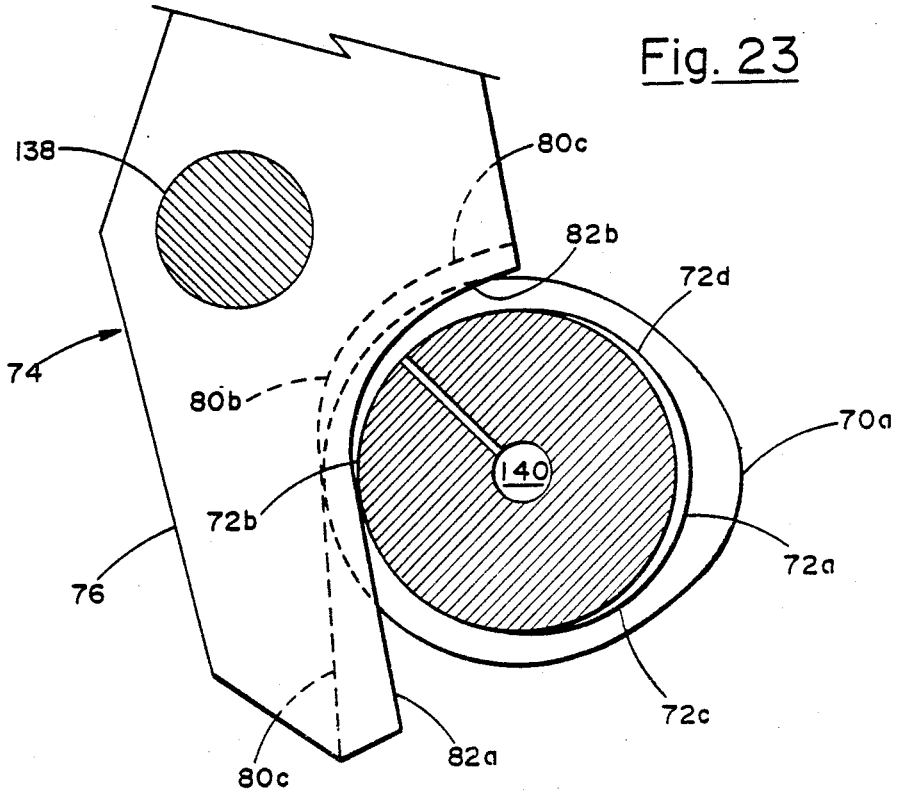
FIGS. 23–25 are fragmentary views indicating a full load condition that is also illustrated in FIG. 13.

It is perhaps desirable to review in greater detail the full load condition of the engine 20, this being when the accelerator pedal 158 is fully depressed. In this situation, the lever arm 134 is pulled downwardly by the hydraulic amplifier 154 so as to bring the vertical leg 76 of the rocker arm 74 into a position where the curved section 80*c* of the follower surface 80 is engaged by the cam lobe 70*a*. As previously indicated, FIGS. 6 and 23 show the rocker arm 74 adjusted so as to condition the valve operating mechanism 66 for a full load operation, that is, a full lift or opening of the valve 26. In FIGS. 6 and 23, the cam unit 68 is in a three o'clock position, but as it rotates clockwise toward a nine o'clock position, the lobe 70*a* acts against the follower surface 80, more specifically, its curved section 80*c*, so as to rock the rocker arm 74 about the pin 138 in a clockwise direction. The rotation of the rocker arm 74 in a clockwise direction causes the eccentric disc 90 of the device 88 to pivotally or rockingly bear on the upper end of the valve stem 32 so that the valve 26 is forced downwardly. The full load or maximum lift condition of the valve 26 is pictorially illustrated in FIG. 7; in other words, FIGS. 7 and 24 correspond to each other, even though the valve 26 is not shown in FIG. 24.

Continued rotation of the cam unit 68 in a clockwise direction will maintain the valve 26 in its open position. Thus, in FIG. 24, the cam lobe 70*a* continues to act against the follower surface 80, more specifically, its section 80*b*, in a direction to open the valve 26. However, once the cam unit 68 has rotated from the position in which it appears in FIGS. 7 and 24 to the position in which it appears in FIGS. 8 and 25, the lobe 70*a* is then acting against the uppermost curved section 80*c* of the cam follower surface 80 so as to rock the rocker arm 74 in an opposite direction, that is, in a counterclockwise direction as viewed in FIG. 8.

The above action first produces a desmodromic action as far as just the rocker arm 74 is concerned, for the cam lobe 70*a* is no longer acting in a direction to open the valve 26; instead, it is acting in a direction to permit the valve 26 to close in that it is causing the rocker arm 74 to rotate in a counterclockwise direction about its pin 138. Such a desmodromic action, as far as the rocker arm 74 is concerned, is advantageous because it relieves the spring 34 of having to exert a sufficiently great force so as to not only act to raise the valve 26 and thereby close it, but to supply a sufficient amount of additional spring energy so as to also rock the rocker arm 74 in a closing direction; the cam lobe 70*a* relieves the spring 34 of having to overcome the inertia of the rocker arm 74. Consequently, the spring 34 must only be strong enough to close the valve 26 and not to rotate the rocker arm 74. In other words, the spring 34 can be considerably weaker than that required with conventional valve operating arrangements.

It must be recognized that it is very desirable to decrease the total amount of mass associated with the closing of the valve 26. After the rocker arm 74 has been rocked through a sufficient angle, the head 110, by reason of its engagement with the leg 122, exerts a positive closing force during the remainder of the time the lobe 70*a* is in engagement with the section 80*c*. As already stated, the strength of the spring 34 can be appreciably reduced inasmuch as the overall closing force is reduced by utilizing the cam 70 itself in causing the valve 26 to accelerate toward its closing position. This only occurs under maximum lift or heavy load conditions, but this is where the desmodromic effect is most needed.

Figure 11:
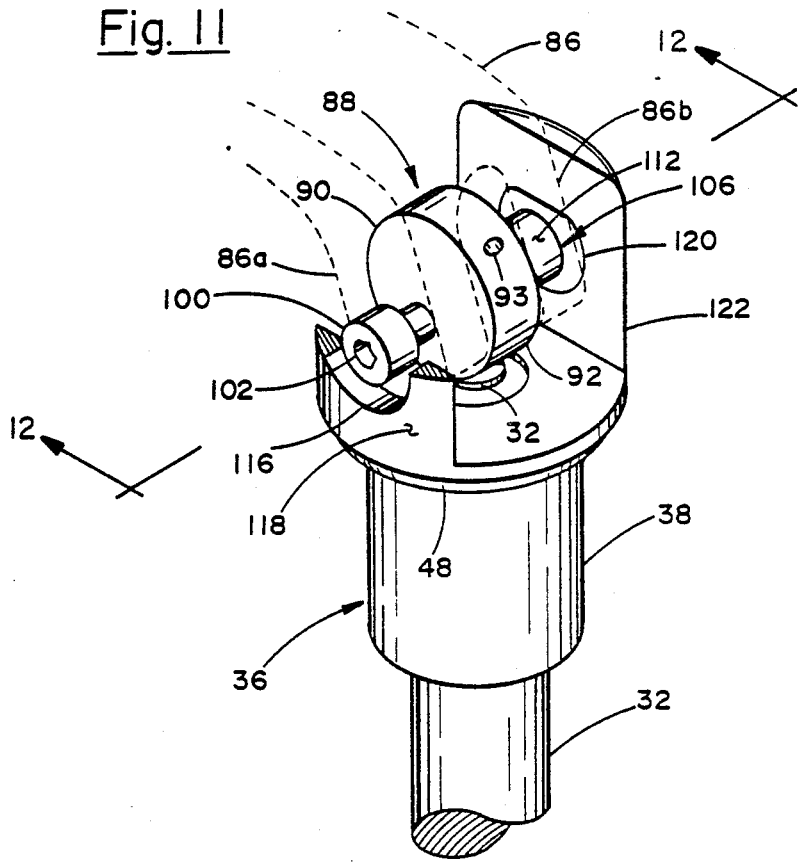
FIG. 11 is an enlarged perspective detail of the free end of the rocker arm.
Figure 12:
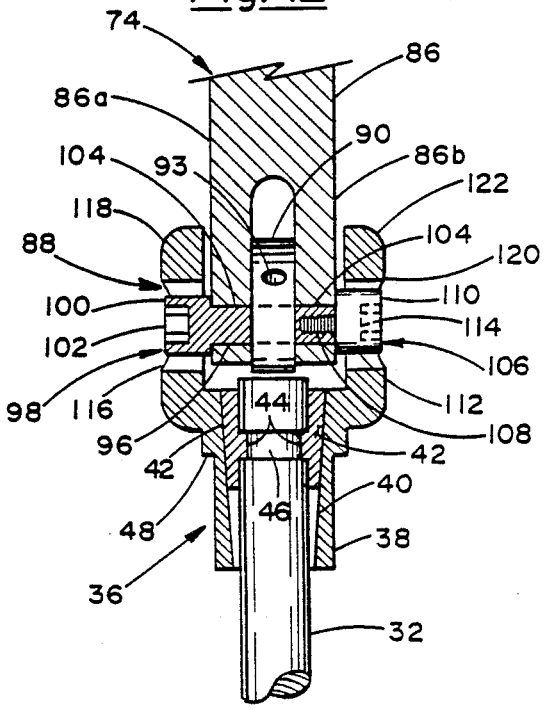
FIG. 12 is a sectional view taken in the direction of line 12—12 in FIG. 11, the view showing two independently adjustable eccentrics for adjusting the lash in one intance and the desmodromic action in the other.

Having mentioned the clearance 168 between the base circle portion 72*b* and the surface or edge section 82*a* as having been adjusted to provide a lash of 0.020 inch, the manner in which such a lash is achieved should now be explained. Reference should be made to FIGS. 11 and 12. All that need be done is to loosen the bolts 98, 106, which when tightened clamp the portions 86*a* and 86*b* against the sides of the disc 90. When the bolt 98 is loose relative to the bolt 106, the disc 90 can be readily rotated on the shank 96 by inserting a suitable implement (even just a stiff wire) into the hole 93. Of course, the clearance between the eccentric peripheral surface 92 of the disc 90, when the valve 26 is closed, constitutes the lash. While the eccentric surface 92 in and of itself reduces the wear that would occur between the disc 90 and the upper end of the valve stem 32, it will soon be made clear when discussing FIG. 9 that there can be a further reduction in rubbing; and a concomitant reduction in friction, by reason of a generally straight line or substantial horizontal condition of the leg 78 which is deliberately established when the valve 26 is half open (or approximately so).

By rotating the now unclamped or free disc 90, the clearance 168 can be varied. With a 0.020 thick feeler gauge inserted between the base circle portion 72*b* and the follower surface or edge section 82*a*, the disc 90 is rotated with whatever implement inserted in the hole 93 until the 0.020 inch feeler gauge becomes snug due to the eccentricity of the peripheral edge 92. The valve 26, quite obviously, remains closed during this step. Once the proper rotative position of the disc 90 is determined, it should remain there until the bolts 98, 106 are again tightened to re-establish the clamped condition of the disc 90 by virtue of the portions 86*a*, 86*b* again pressing against the sides of the disc 90.

Before retightening the bolts 98, 106 with respect to each other, the mechanic twists the bolt 106 by means of a socket wrench to rotate its head 110 into a position such that its eccentric periphery 112 provides the proper clearance between it and the top of the aperture 120 in the leg 122 of the retainer 36. This determines the amount of desmodromic action involving only the rocker arm 74, as earlier mentioned. Once the head 110 engages the leg 122, also as hereinbefore mentioned, a desmodromic action involving both the rocker arm and the valve 26 occurs, which continues, as previously explained, until the cam lobe 70*a* rotates past the curved follower section 80*c*.

Recapitulating, it should be explained that under no load or light load conditions, the lever arm 134 is raised, as can be discerned from FIG. 2. However, as the lever arm 134 is lowered into a substantially horizontal position, as is evident in FIGS. 4 and 5, then the rocker arm 74 is rocked about the currently fixed axis (but which can be shifted to various fixed positions by the device 146) provided by the pin 138. This rocking action brings a portion of the follower surface 80 into a position where it is acted upon by the cam lobe 70*a*, as specifically shown in FIG. 5, which causes the valve 26 to open part way. In order to appreciate the benefits to be derived from a practicing of my invention, it should be recognized at this stage that the leverage ratio that is effective for opening the valve 26 is measured between the centerline of the pin 138 and the specific point on the follower surface 80 that is being engaged by the cam lobe 70*a* at any given moment, taken in relation to the distance between the centerline of the pin 138 and the point of contact between the disc 90 and the top of the valve stem 32.

Whereas in FIG. 7 the moment arm or mechanical advantage is reduced under full load or large lift conditions from that present in FIG. 6, in that the lobe 70*a* is engaging a portion or section of the cam follower surface 80 that is nearer the centerline of the pin 138, it follows that the rate at which the valve 26 is opened and closed is increased. Hence, when the lever ratio is decreased, the valve 26 is opened at a much faster rate. This, without any ramp compensation, creates impact forces that can be injurious to the valve 26, causing damaging hertzian forces to be generated.

The leverage ratio can be changed by imparting a reverse inclination to the cam follower surface 80, more specifically, the linear section 80*a*. This is illustrated in FIGS. 26–29, and will now be dealt with. In this regard, the hydraulic amplifier 154, when using the reverse or opposite inclination, will act in an opposite direction as far as its movement of the lever arm 134 is concerned. In this regard, the position of the rocker arm 74, as it appears in FIG. 27, indicates a maximum lift condition. It is when the lever arm 134 is lowered, as in FIG. 26, so as to present an upper section 180*a* of the negative line 180 to the cam lobe 70*a* so that the valve lift is decreased, this relationship being just the opposite resulting from the employment of the positive inclination line 80.

An important feature of my invention is that the severity of the shock in opening and closing the valve 26 can be lessened. As mentioned above, this can be achieved by imparting a reverse inclination to the cam follower surface 180 from that of the follower surface 80. However, irrespective of whether the reverse inclination or line 180 is used, the operating mechanism 66, as described in conjunction with FIGS. 2–10 and 14–25, appreciably minimizes the severity of shock, this being so by use of ramps which moderate the acceleration and deceleration of valve opening and closing. The ramps 70*c* and 70*d* on the cam 70 and the ramps 72*c* and 72*d* on the cam 72 to either side of the cam 70 effectively achieve this. The ramp feature additionally results in a shifting of wearing surfaces in that under lesser loads, various angular segments of the ramp portion 72*c* engage either the sections 82*a* or 82*b*, as the case may be, prior to the lobe portion 70*a* striking the follower sections 80*a* or 80*b*, also as the case may be. The converse holds true for the portion 72*d*, there being one ramp portion 72*d* to either side of the cam 70, in that the portion 72*d* engages either the sections 80*a* or 80*b* to gradually permit the valve 26 to close after the lobe 70*a* completes its engagement of the follower surface 80. It is believed that FIG. 10 adequately portrays how the shifting of wear that has just been mentioned is realized.

Only a brief description of FIGS. 26–29 is believed necessary. As already indicated, the use of a negative or reverse inclination changes the leverage ratio so that the valve 26 opens at a slower rate at full load than when the inclination is positive. In FIG. 26, which represents a no load condition, the lever arm 134 is angled so that the vertical leg 76 of the rocker arm 74 presents the upper section 180*a*, which is part of the reversed follower surface 180, to the cam 70 as it rotates from the three o'clock position of FIG. 26 to the nine o'clock position of FIG. 27. The valve 26 remains closed in both of these two figures.

However, when the vertical leg 76 of the rocker arm 74 is raised so as to present the lower section 180*b* to the cam 70, the valve 26 is opened as the cam 70 rotates from its three o'clock position of FIG. 28 to the nine o'clock position of FIG. 29.

It should be recognized that the moment arm or mechanical advantage is less in FIG. 29 than in FIG. 7. In other words, the valve 26 is opened at a slower rate in the FIG. 29 situation than in FIG. 7 owing to the negative inclination of the follower surface 180 as compared with the surface 80 in FIG. 7 (and also other views as well).

Figure 30:
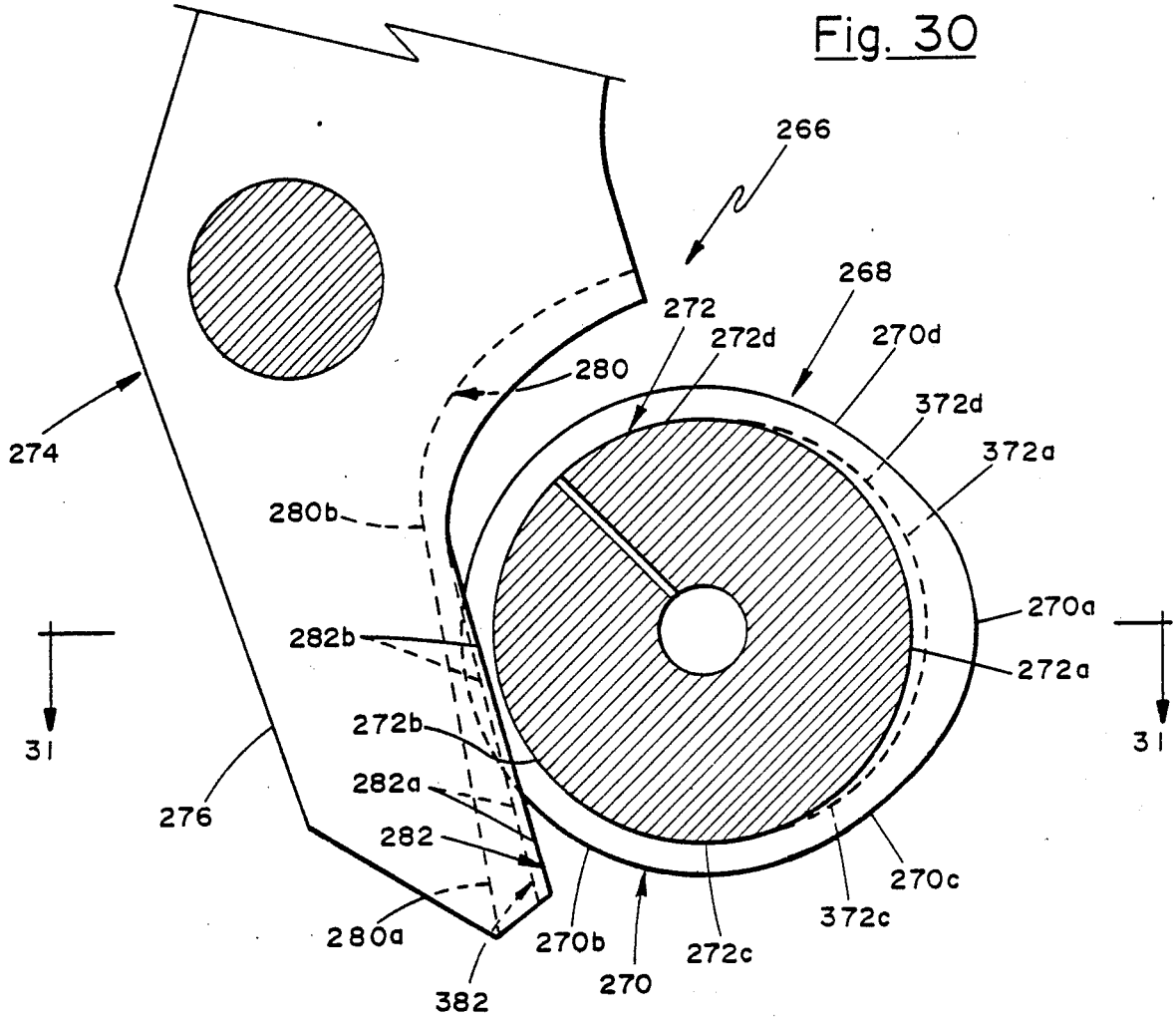
FIG. 30 is an enlarged fragmentary view of a modified cam unit and rocker arm, the position thereof corresponding generally to that illustrated in FIG. 4.
Figure 31:
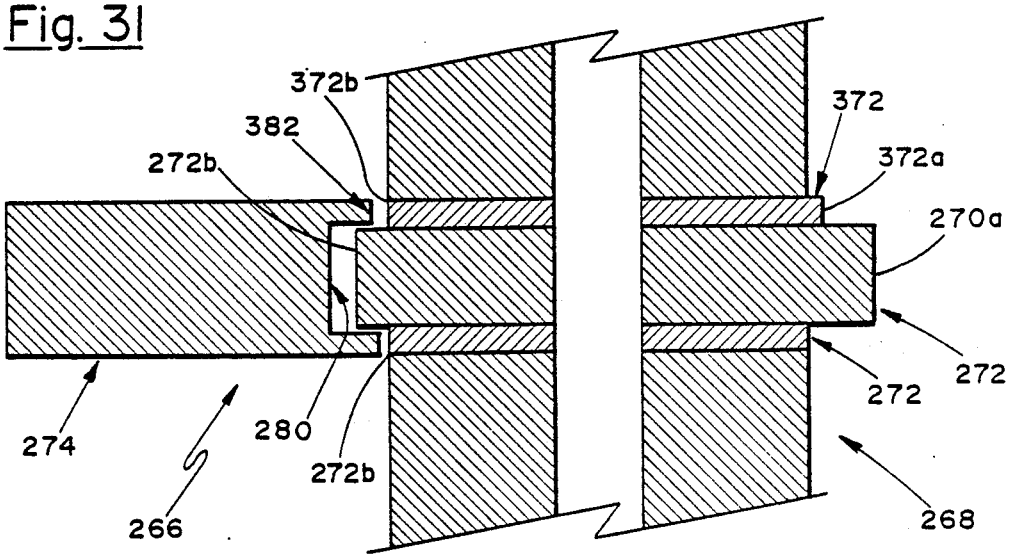
FIG. 31 is a sectional view taken in the direction of line 31—31 of FIG. 30.

To demonstrate the versatility of my invention, reference will now be made to FIGS. 30 and 31. The valve control mechanism has been denoted generally by the reference numeral 266 in these two figures, even though only certain parts are included. It might be explained at the outset, however, that the object in this instance is to present a mechanism utilizing base circles of different diameters and various ramps having differing slopes, no two base circles or ramps of which are precisely alike.

The cam unit in conjunction with the modified mechanism 266 has been assigned the reference numeral 268. The cam unit 268 includes a central cam 270 having a lobe portion 270*a*, a base circle portion 270*b* and ramp portions 270*c* and 270*d*, the ramp portions 270*c* and 270*d* differing, if desired, in their arcuate span and slope from each other.

The cam unit 268 includes what will be called a second cam 272 at one side of the central cam 270. In this instance, the so-called cam 272 is in the form of a cylindrical disc providing a 360° base circle portion for a reason presently to be explained. At this point, however, it is to be emphasized that there is no eccentric portion and no ramp portions associated with the cam 272. In other words, the portions 272*a*, 272*b*, 272*c* and 272*d* are all of equal radius; they have been labeled only for ease of reference.

However, the second cam labeled 372 can be like one of the cams 72, which earlier herein were referred to as being identical. It differs markedly from the cam 272 in that it has an eccentric portion 372*a*, a base circle portion 372*b* which can have the same radius the base circle portion 272*b*. Also formed are ramp portions 327*c* and 372*d* which may differ from each other, if desired.

Complementing the configuration of cam unit 268 is a modified rocker arm 274, it being only necessary to point out that just its vertical leg 276 differs in order to coact with the different shape of the cam unit 268. Accordingly, the leg 276 has formed thereon a cam follower surface denoted generally by the reference numeral 280. The surface 280 includes a lower section 280*a* and an upper section 280*b*. The sections 280*a*, 280*b* are selectively engaged by the portions 270*a*, 270*b*, 270*c* and 270*d*.

Another cam follower surface formed on the leg 276 has been denoted generally by the reference numeral 282, being comprised of generally straight or linear sections labeled 282*a* and 282*b*. The sections 282*a*, 282*b* are selectively engaged by the base circle portions 272*a*, 272*b*, 272*c* and 272*d* of the cam 272; there are no ramp portions on the cam 272 as already explained.

Still an additional cam follower surface 382 is formed on the leg 276. The sections thereof have been labeled 382*a* and 382*b*, and are engaged by the portions 372*a*, 372*b*, 372*c* and 372*d* provided on the cam 372.

Although a number of different base circle diameters can be selected, as well as different ramp configurations, it should be appreciated that the employment of the cam 272 in which the base circle extends completely therearound enables a very small lash or clearance to be set. More specifically, the clearance between the periphery of the cam 272 and the follower surface 282 can be set for, say, 0.005 inch which can keep the valve noise to a bare minimum. However, when the valve 26 (not shown in FIGS. 30 and 31) is to be open, whether slightly or fully, the ramps 372*c* and 372*d* work to take over from the 0.005 inch lash, assuming that a greater clearance, say, 0.020 inch has been set between the base circle portion 372*b* and the follower surface 382.

The point to be recognized from the above description, however, is that the cam unit 268 and the complementing vertical leg 276 allow a number of cam profile choices to be made. For instance, the ramp portion 372*c* can possess a greater slope than the ramp portion 372*d*, thereby causing the valve 26 to complete its closing at a slower rate than the rate that it opens. While the cam 272 differs from the cam 372 in that the cam 272 has no ramps, it could have one or two ramps differing in slope and/or arcuate span from each other, as well as differing from the profile of the ramps 372*c* and 372*d*. The profile design choices are virtually limitless.

Attention is now directed to FIG. 9 where a half-open condition of the valve 26 is illustrated. Obviously the cam unit 68 is in, for all intents and purposes, its nine o'clock position. What should be understood is that the centerline of the pin 138 is in the same horizontal plane as the upper end of the valve stem 32. The centerline of the shaft 132, which provides a fixed axis about which the lever arm 134 pivots, resides generally in the same horizontal plane. A true straight line relationship of the shaft 132 with the upper end of the stem 32 and the centerline of the pin 138, under these half-open circumstances, need not exist. However, the closer, the better. What results is that as the rocker arm 74 rocks in either a clockwise direction (to open the valve 26 to a greater degree) or a counterclockwise direction (to permit the valve to close to a greater degree). The oscillation or rocking of the disc 90 relative to the upper end of the valve stem 32 is substantially reduced with an accompanying reduction in rubbing or wiping across the upper end of the stem 32. This optimum condition prevails for various valve lifts or valve openings, for the pin 138 is shifted in the same direction that the valve 26 is being moved by the rocker arm 74. It will, therefore, be appreciated that the movement of the pin 138 is in a direction favorable to minimizing friction between the free end of the rocker arm leg 78, and the upper end of the valve stem 38, more specifically, between the disc or wheel 90 and the valve stem 38. This in turn reduces the amount of wear. Consequently, once the lash has been determined, such as the rotative adjustment of the disc 90 to provide the 0.020 inch lash that has been previously described, it is unlikely that the lash will noticeably increase, particularly when it is appreciated that the ramps 70*c*, 70*d*, 72*c* and 72*d* very effectively cooperate in the achieving of this heretofore elusive goal.

I claim:

1. In combination with an internal combustion engine having a rotatable camshaft, a cam on said camshaft, a combustion chamber and a reciprocable valve member for opening and closing a valve port in communication with the combustion chamber, a mechanism for operating said valve member comprising a rocker arm having first and second angularly disposed and integrally connected legs, said first leg having a cam follower surface thereon having a first section thereof extending in the same general direction that said valve member reciprocates and having a second section thereof curving toward said valve member and toward the direction in which said valve member reciprocates, means mounting said rocker arm for rocking movement about a first axis, and means for shifting said first axis relative to said camshaft in also the same general direction said valve member reciprocates so that various portions of said first and second sections of the cam follower surface on said first leg are relatively engageable with said cam, sufficient shifting of said first axis in said same general direction producing a desmodromic action, and said second leg including a single portion thereof engaging said valve member so that only said single portion acts on said valve member.

2. The combination of claim 1 in which said first section is linear.

3. The combination of claim 1 in which said means for shifting said first axis shifts said first axis about a second axis.

4. The combination of claim 3 in which said second axis is fixed.

5. The combination of claim 4 in which said second axis is intermediate said first axis and said free end.

6. The combination of claim 5 in which said first axis intersects said first leg between said cam follower surface and the juncture where said legs are integrally connected.

7. The combination of claim 1 in which said first leg has a second cam follower surface adjacent said first cam follower surface and relatively engageable with said cam means.

8. The combination of claim 7 in which said first and second cam follower surfaces have different profiles, said second follower surface having a linear section providing a profile different from that of the first section of said first surface and having a curved section providing a profile different from that of the second section of said first surface.

9. The combination of claim 8 in which said cam means includes a first cam engageable with said first follower surface, said first cam having a lobe portion, a base circle portion and first and second ramp portions, said first ramp portion increasing in radius between said base circle portion and said lobe portion, and said second ramp portion decreasing in radius between said lobe portion and said base circle portion, said cam means including a second cam adjacent said first cam engageable with said second follower surface, said second cam having an eccentric portion, a base circle portion and first and second ramp portions, the first ramp portion of said second cam increasing in radius between the base circle of said second cam and said eccentric portion, and the third ramp portion of said second cam decreasing in radius between said eccentric portion and the base circle portion of said second cam.

10. The combination of claim 9 in which said lobe portion and said eccentric portion are in general radial alignment, and said lobe portion has a greater radius than said eccentric portion.

11. The combination of claim 10 in which the profiles of said first and second follower surfaces cause the first ramp portion of said second cam to engage said second follower surface prior to said lobe portion engaging the first follower surface of said first cam when said first axis is shifted into a first position relative to said camshaft.

12. The combination of claim 11 in which the profiles of said first and second follower surfaces also cause the second ramp portion of said cam to engage said second follower surface before said lobe portion has engaged said first follower surface when said first axis is shifted into said first position relative to said camshaft.

13. The combination of claim 12 in which the profiles of said first and second follower surfaces additionally cause the first ramp portion of said first cam to engage said first follower surface without the first ramp portion of said second cam engaging said second follower surface when said first axis is shifted into a second postion relative to said camshaft.

14. The combination of claim 13 in which the profiles of said first and second follower surfaces additionally cause the second ramp portion of said first cam to engage said first follower surface without the second ramp portion of said second cam engaging said second follower surface when said first axis is shifted into said second postion relative to said camshaft.

15. The combination of claim 14 including eccentric means at the free end of said second leg for engaging said valve member.

16. The combination of claim 15 in which said valve member includes a stem and said eccentric means includes a rotatable disc member having an eccentric periphery for adjusting the clearance between said disc periphery and the end of said valve stem.

17. The combination of claim 16 in which the free end of said second leg has a slot for the reception of said disc member therein, and means for clamping said disc member in an adjusted rotated position.

18. The combination of claim 17 in which the free end of said second leg has a pair of transversely aligned holes, and said clamping means includes a shaft on which said disc member is rotatably mounted, and a member threadedly engaged with one end of said shaft for tightening said free end of said second leg against said disc member.

19. The combination of claim 1 in which said curved section is profiled so that said cam means acts thereagainst to produce said desmodromic action when the valve is at its approximate fully open position to assist in closing said valve.

20. The combination of claim 1 in which said cam follower surface includes a section having a positive inclination so that the leverage ratio is increased as the valve member is progressively opened.

21. The combination of claim 1 in which said cam means engages said cam follower surface relatively far from said first axis and said follower surface having a negative inclination.

22. In combination with an internal combustion engine having a rotatable camshaft, a combustion chamber and a reciprocable valve member for opening and closing a valve port in communication with the combustion chamber, a mechanism for operating said valve member comprising cam means on said camshaft, a rocker arm having first and second angularly disposed and integrally connected legs, said first leg having a cam follower surface thereon which includes a concave portion curving into a generally overlying relation with said camshaft, means mounting said rocker arm about a first axis, means for shifting said first axis relative to said camshaft so that various portions, including said curved portion, of the cam follower surface on only said first leg are relatively engageable with said cam means, and means at the free end of said second leg spaced from said first leg connecting said free end to said valve member, said cam means engaging said curved portion of said follower surface to assist in closing said valve.

23. The combination of claim 22 in which said valve member includes a valve stem, a coil spring encircling said valve stem, a spring retainer attached at the free end of said valve stem having a leg formed with a hole therein, and said connecting means at the free end of said second leg including an eccentric device having a first eccentric member engageable with said valve stem and a second eccentric member extending from said first eccentric member into said hole for engagement with a portion of said leg circumjacent said hole, whereby when said cam means is engaging said curved follower surface, said second leg, by reason of its connection to said valve stem, acts in a direction to reduce the force needed by said spring when closing said valve member.

24. In combination with an internal combustion engine having a rotatable camshaft, a combustion chamber and a reciprocable valve member for opening and closing a valve port in communication with the combustion chamber, a mechanism for operating said valve member comprising a first cam on said camshaft including a base circle portion, a lobe portion, a first ramp portion increasing in radius from said base circle portion to said lobe portion and a second ramp portion decreasing in radius from said lobe portion to said base circle portion, a second cam on said camshaft including a base circle portion, an eccentric portion, a fixed ramp portion increasing in radius from said base circle portion to said eccentric portion and a second ramp portion decreasing in radius from said eccentric portion to said base circle portion, rocker arm means including first and second angularly perpendicularly disposed and integrally connected legs, means mounting said rocker arm for rocking movement about a first axis, first follower means on said first leg engageable by said first cam, said first follower means having a curved portion for providing a desmodromic action, and second follower means also on said first leg engageable by said second cam, and means for shifting said rocker arm means about said first axis and relative to said first and second cams into a first position so that the first ramp portion of said second cam engages said second follower means at one location thereon before the first ramp portion of said first cam engages said first follower means as said camshaft rotates.

25. The combination of claim 24 in which the clearance between the base circle portion of said second cam and said second follower means constitutes valve lash, means carried by said rocker arm means for adjusting the amount of the valve lash, said adjusting means including first eccentric means mounted on said rocker arm means, the angular position of said first eccentric means determining valve lash, a spring retainer on said valve member having an upstanding leg formed with a hole therein, and second eccentric means threadedly attached to said first eccentric means, the angular position of said second eccentric means determining the time at which the desmodromic action occurs.

26. The combination of claim 25 in which said rocker arm means includes first and second angularly disposed and integrally connected legs, said first leg having said first and second follower means thereon, and said second leg having said means for adjusting the amount of lash thereon.

27. In combination with an internal combustion engine having a rotatable camshaft, a combustion chamber and a reciprocable valve member for opening and closing a valve port in communication with the combustion chamber, the valve member having a valve stem, a mechanism for operating said valve member comprising a cam on said camshaft, L-shaped rocker arm having first and second right angularly disposed and integrally connected legs, said first leg having a cam follower surface thereon extending generally in the same direction said valve member reciprocates, a lever arm, means mounting one end of said lever arm for pivotal movement about a fixed axis, means pivotally connecting the first leg of said rocker arm to said lever arm to provide a movable or shiftable axis, means for pivoting said lever arm about said fixed axis to shift said said movable axis relative to said camshaft in generally the same direction said valve member reciprocates so that various portions of the cam follower surface on said first leg are relatively engageable with said cam means, and means at the free end of said second leg for actuating said valve member.

28. The combination of claim 27 in which said valve member is movable between a fully closed position and a fully open position, said fixed and movable axes residing in the same general plane with the free end of the valve stem when said valve member is approximately half open.

29. In combination, an internal combustion engine having a camshaft rotatable about a first axis, a cam on said camshaft, a combustion chamber, a valve member mounted for reciprocation along a second axis perpindicular to said first axis for opening and closing a valve port in communication with said combustion chamber, a mechanism for operating said valve member comprising a rocker arm having first and second generally perpendicular legs, a lever arm, means mounting said lever arm for pivotal movement about a third axis spaced from said first axis, means mounting said rocker arm on said lever arm for rocking movement about a fourth axis spaced from both said first and third axes, said first leg having a cam follower surface including a concavely curved section engageable by said cam when said fourth axis is shifted in a direction to cause said cam to engage said curve section, a portion of said curved section then extending generally in the direction of said third axis from a line or a plane passing through said first and fourth axes so that said cam then rocks said rocker arm in an opposite direction from that in which said cam rocks said rocker arm when said cam is engaging a portion of said follower surface residing to the other side of said line or plane.

30. In combination with an internal combustion engine having a rotatable camshaft, a cam on said camshaft, a combustion chamber and a reciprocable valve member for opening and closing a valve port in communication with the combustion chamber, said valve member including a stem, means on said stem and movable in unison therewith providing an aperture, and a mechanism for operating said valve comprising a rocker arm having first and second angularly disposed and integrally connected legs, said first leg having a cam follower surface thereon extending in the same general direction that said valve member reciprocates and having a curved protion integral therewith for providing a desmodromic action, means mounting said rocker arm for rocking movement about a first axis, means for shifting said first axis relative to said camshaft in also the same general direction said valve member reciprocates so that various portions, including said desmodromic portion, of the cam follower surface on said first leg are relatively engageable with said cam, and means at the free end of said second leg for determining the amount of desmodromic action, eccentric means at the free end of said second leg for engaging said stem, said eccentric means including a rotatable disc member having an eccentric periphery for adjusting the clearance between said disc periphery and the end of said valve stem, the free end of said second leg having a slot for the reception of said disc member therein, means for clamping said disc member in an adjusted rotative position including a shaft on which said disc member is rotatably mounted, and a member threadedly engaged with one end of said shaft for tightening said free end of said second leg against said disc member.

* * * * *